US006346360B1

(12) United States Patent
Verbeeck et al.

(10) Patent No.: US 6,346,360 B1
(45) Date of Patent: Feb. 12, 2002

(54) RADIOGRAPHIC FILM MATERIAL EXHIBITING INCREASED COVERING POWER AND "COLDER" BLUE-BLACK IMAGE TONE

(75) Inventors: Ann Verbeeck, Begijnendijk; Freddy Henderickx, Olen, both of (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/706,835

(22) Filed: Nov. 7, 2000

Related U.S. Application Data

(60) Provisional application No. 60/211,927, filed on Jun. 16, 2000.

(30) Foreign Application Priority Data

Nov. 26, 1999 (EP) ..... 99204006
Nov. 26, 1999 (EP) ..... 99204008

(51) Int. Cl.[7] ..... G03C 5/17; G03C 1/35; G03C 1/035; G03C 1/46

(52) U.S. Cl. ..... 430/139; 430/502; 430/567; 430/965; 430/966

(58) Field of Search ..... 430/567, 502, 430/965, 139, 966

(56) References Cited

U.S. PATENT DOCUMENTS

| | | | | |
|---|---|---|---|---|
| 4,883,748 A | | 11/1989 | Hayakawa | |
| 5,595,864 A | * | 1/1997 | Zegel et al. | 430/569 |
| 5,759,759 A | | 6/1998 | Adin et al. | |
| 5,955,249 A | | 9/1999 | Adin et al. | |

FOREIGN PATENT DOCUMENTS

| | | |
|---|---|---|
| EP | 0 475 191 A3 | 3/1992 |
| EP | 0 475 191 A2 | 3/1992 |

OTHER PUBLICATIONS

Derwent Publications, Ltd., London, GB; Section Ch, Week 199939, Class G06, AN 1999–463368, XP002140667 & JP 11–194439 A (Konica Corp.), Jul. 21, 1999.

* cited by examiner

*Primary Examiner*—Richard L. Schilling
(74) *Attorney, Agent, or Firm*—Breiner & Breiner, L.L.C.

(57) ABSTRACT

A radiographic film material has been provided, comprising a transparent film support having first and second major surfaces coated, apart from a subbing layer and, optionally, a non-light-sensitive hydrophilic layer thereupon, with at least one light-sensitive silver halide emulsion layer overcoated with a protective antistress layer, said emulsion layer(s) having chemically and spectrally sensitized {111} tabular hexagonal core-shell emulsion grains or crystals in an amount of at least 50% of the total projective grain surface of all grains, said grains being composed of a silver bromide core and a silver bromoiodide shell having an average amount over the whole crystal volume of more than 90 mole % of silver bromide, said grains further having a mean equivalent volume diameter of from 0.3 $\mu$m up to 1.0 $\mu$m and an average grain thickness of less than 0.30 $\mu$m, wherein said film material is coated with a total amount of silver, expressed as an equivalent amount of silver nitrate of less than 7 g/m2, characterized in that all silver iodide is present in an outermost shell corresponding with at most 20% of all silver halide precipitated in order to provide silver iodide to be present in the whole grain volume of said tabular grains in an average amount of less than 1 mole % of iodide, based on silver and in that said protective antistress layer, said non-light-sensitive hydrophilic layer or both said protective antistress layer and said non-light-sensitive hydrophilic layer comprise a mercapto-tetrazole compound as in general formula (I), presented in the claims and in the detailed description, said compound being present in high amounts of at least 0.5 mmole per mole of silver halide coated.

13 Claims, No Drawings

RADIOGRAPHIC FILM MATERIAL EXHIBITING INCREASED COVERING POWER AND "COLDER" BLUE-BLACK IMAGE TONE

Benefit is claimed under 35 usc 119(e) based on provisional application No. 60/211,947, filed Jun. 16, 2000.

FIELD OF THE INVENTION

The present invention relates to a radiographic light-sensitive silver halide photographic film material and a combination of intensifying screens having luminescent phosphors and said film material comprising in the light-sensitive emulsion layers hexagonal {111} tabular emulsion grains rich in silver bromide.

BACKGROUND OF THE INVENTION

Since the early eighties practical use of light-sensitive tabular silver halide grains or crystals has become common knowledge for anyone skilled in the art of photography. From Eastman Kodak's basic patents relied thereupon those related with the preparation of {111} tabular silver halide grains, sensitivity increase by spectral and chemical sensitization, and coating in a light-sensitive silver halide photographic material, more particularly in a forehardened duplitized radiographic material showing improved covering power for tabular grains having a thickness of less than 0.20 $\mu$m as described in U.S. Pat. No. 4,414,304 and in the patents corresponding therewith in Japan and in the European countries, it becomes clear that problems encountered by making use of such grains are related with image tone and developability as has also been set forth in U.S. Pat. No. 5,595,864.

In radiographic applications the film materials are coated with relatively high amounts of silver, in order to provide a suitable sensitometry even if a low radiation dose is applied to the patient as is always desirable. Although the use of {111} tabular silver halide grains permits coating of lower amounts of silver, if compared e.g. with grains having a more globular shape as applied before practical application of said tabular grains, there remains the need to provide an acceptable image tone after development of materials having light-sensitive silver halide layers containing said tabular grains. Reduction of thickness of the {111} tabular grains coated in a radiographic film material hitherto, although providing a higher covering power, remains unambiguously related indeed with the occurrence, after processing of such materials, of diagnostic images having an unacceptable reddish-brown image tone for radiologists as image tone and image quality are closely related with each other in the specific context of examination of diagnostic images.

Measures taken in order to get a shift in image tone from reddish-brown to the desired bluish-black color of the developed silver, well-known from the state-of-the-art are hitherto unsatisfactory. Coating light-sensitive emulsion layers on a blue base as in U.S. Pat. No. 5,800,976 makes increase minimum density, a phenomenon which is interpreted by the radiologist as an undesired increase of "fog density". Incorporation in the other layers of the film material of such dyes or dye precursors providing blue color directly or indirectly (by processing and oxidative coupling reactions) are e.g. known from U.S. Pat. Nos. 5,716,769 and 5,811,229 and EP-A 0 844 520, and JP-A 10-274 824 respectively and causes the same problems as set forth hereinbefore, moreover showing, in the worst cases, staining of the screens with blue dyes diffusing from the material onto the screen, with residual color of dyes due to uncomplete removal of said dyes in, nowadays desired, rapid processing steps and problems related with criticality of generation of imagewise developed blue colored silver and preservation characteristics of the material.

Therefore there remains a stringent demand to get a desired blue-black image tone of a diagnostic image without disturbing residual color obtained after processing of the radiographic light-sensitive silver halide film material having stored the latent image of the subject to be examined.

OBJECTS OF THE INVENTION

It is a first object of the present invention to provide a better image tone after processing of a radiographic light-sensitive silver halide film material.

It is a second object of the present invention to avoid negative influences on diagnostic value due to residual stain resisting in the film material after processing.

It is a further object of the present invention to provide improved preservation characteristics for the material.

It is still a further object of the present invention to prevent loss in sensitometric characteristics, especially speed and gradation, even in differing processing conditions.

Further objects will become apparent from the description hereinafter.

SUMMARY OF THE INVENTION

In order to reach the objects set forth above a radiographic film material has been provided, said material comprising a transparent film support having first and second major surfaces coated, apart from a subbing layer and, optionally, a non-light-sensitive hydrophilic layer thereupon, with at least one light-sensitive silver halide emulsion layer overcoated with a protective antistress layer, said emulsion layer(s) having chemically and spectrally sensitized {111} tabular hexagonal core-shell emulsion grains or crystals in an amount of at least 50% of the total projective grain surface of all grains, said grains being composed of a silver bromide core and a silver bromoiodide shell having an average amount over the whole crystal volume of more than 90 mole % of silver bromide, said grains further having a mean equivalent volume diameter of from 0.3 $\mu$m up to 1.0 $\mu$m and an average grain thickness of less than 0.30 $\mu$m, wherein said film material is coated with a total amount of silver, expressed as an equivalent amount of silver nitrate of less than 7 g/m2, characterized in that all silver iodide is present in an outermost shell corresponding with at most 20% of all silver halide precipitated in order to provide silver iodide to be present in the whole grain volume of said tabular grains in an average amount of less than 1 mole % of iodide, based on silver (preferably said silver iodide is present on the grain surface of the said core-shell tabular grains in an amount in order to get an average amount of iodide from 0.1 mole % up to less than 1.0 mole %, an still more preferred of from 0.1 mole % up to 0.4 mole %, based on silver over the whole grain volume) and in that said protective antistress layer, said non-light-sensitive hydrophilic layer or both said protective antistress layer and said non-light-sensitive hydrophilic layer comprise a mercaptotetrazole compound according to the general formula (I), (I)

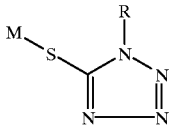

wherein R represents a substituted or unsubstituted alkyl, aryl or aralkyl and wherein M represents a hydrogen atom, an alkali metal atom or an ammonium group, in an amount of at least 0.5 mmole per mole of silver halide coated.

Moreover a radiographic screen/film combination or system has been provided, said system comprising a radiographic film material according to any of claims 1 to 8, sandwiched between a pair of supported or self-supporting X-ray intensifying screens, wherein said pair of supported or self-supporting X-ray intensifying screens comprises luminescent phosphor particles emitting at least 50% of their emitted radiation in the wavelength range for which said material has been made spectrally sensitive.

Black-and-white image-forming method comprising the steps of contacting the film material set forth above, sandwiched between a pair of supported or self-supporting X-ray intensifying screens, wherein said intensifying screens comprises luminescent phosphor particles emitting at least 50% of their emitted radiation in the wavelength range for which said material has been made spectrally sensitive; exposing the film material to X-rays passing a subject to be examined, while being in contact with the said screens; followed by processing the film material by the steps of developing, fixing, rinsing and drying.

DETAILED DESCRIPTION OF THE INVENTION

The radiographic film material of the present invention thus comprises a transparent film support having first and second major surfaces coated with a subbing layer, optionally overcoated with a non-light-sensitive hydrophilic layer (also called "antihalation undercoat"), further coated adjacent to said subbing layer or said non-light-sensitive hydrophilic (antihalation) layer layer, on each side of said film support a light-sensitive silver-halide emulsion overcoated with a protective antistress layer, said emulsion layer(s) having chemically and spectrally sensitized {111} tabular hexagonal core-shell emulsion grains or crystals in an amount of at least 50%, preferably at least 70% and most preferably at least 90% of the total projective surface of all grains, said grains being composed of a silver bromide core and a silver bromoiodide shell having an average amount over the whole crystal volume of more than 90 mole % of silver bromide, said grains further having a mean equivalent volume diameter of from 0.3 $\mu$m up to 1.0 $\mu$m and an average grain thickness of less than 0.30 $\mu$m, an amount of at most 3 mole %, based on silver, the said tabular grains having a mean equivalent volume diameter of from 0.3 $\mu$m up to 1.0 $\mu$m and an average grain thickness of less than 0.30 $\mu$m, wherein said film material is coated with a total amount of silver halide, expressed as an equivalent amount of silver nitrate of less than 7 g/m2, characterized in that said protective antistress layer, said antihalation undercoat or both said protective antistress layer and said antihalation undercoat comprise a mercapto-tetrazole compound according to the general formula (I), given in the detailed description hereinafter and in the claims, in an amount of at least 0.5 mmole, more preferably, from 1 mmole up to 10 mmole per mole of silver halide coated.

It is an essential feature of the present invention to add to the protective antistress layers of the radiographic double-side coated or duplitized material, besides the normally added components (see Examples) a mercapto-tetrazole compound according to the general formula (I), in exceptionally huge amounts of at least 0.5 mmole per mole of coated silver, more preferred from 1 mmole up to 5 mmole and even more preferred up to an amount of 10 mmole per mole of coated silver halide. It has been established that the presence of such compounds in the non-light sensitive hydrophilic layers of the said radiographic material (as are the protective antistress layers and the optionally present antihalation undercoats between subbing layer and light-sensitive emulsion layer, both hydrophilic layers being coated adjacent to the light-sensitive silver halide emulsion layers) further improves image tone in that a "colder" blue-black image is obtained for at least the same and even an increased covering power.

The compound satisfying formula (I) has a general structure given hereinafter:

(I)

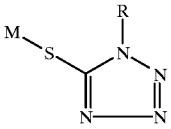

wherein R represents a substituted or unsubstituted alkyl, aryl or aralkyl and wherein M represents a hydrogen atom, an alkali metal atom or an ammonium group, Preferred mercapto-tetrazole compounds according to the general formula (I), are represented hereinafter in the formulae (I.1–14):

(I.1)

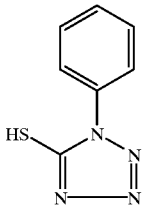

(I.2)

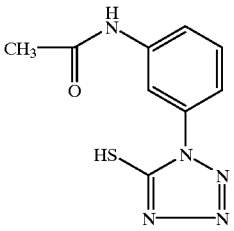

-continued
(I.3)
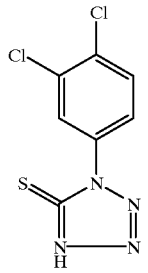
(I.4)
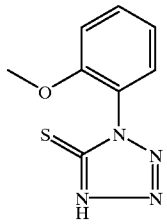
(I.5)
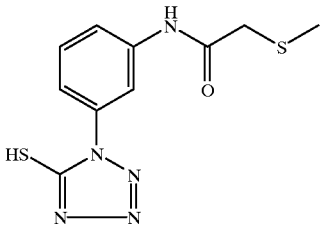
(I.6)
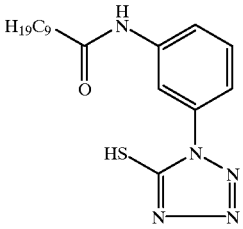
(I.7)
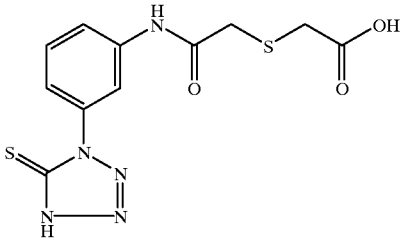
(I.8)
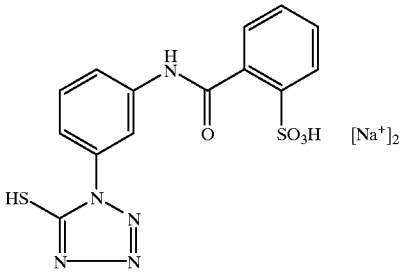
-continued
(I.9)
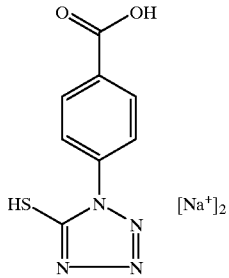
(I.10)
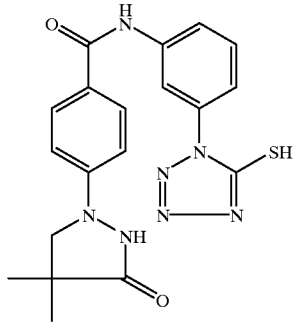
(I.11)
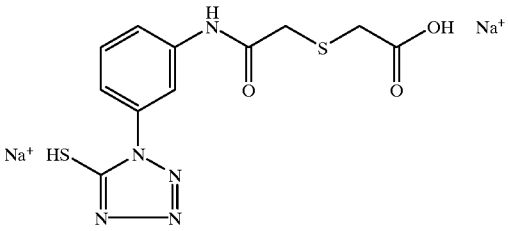
(I.12)
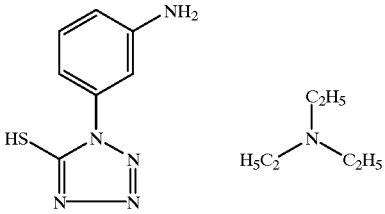
(I.13)
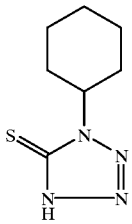
(I.14)
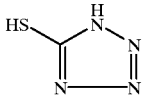
The protective antistress layers of the radiographic material according to the present invention may be the outermost layers of the material but an outermost afterlayer may be optionally present as disclosed e.g. in EP-A's 0 644 454 and 0 644 456, wherein e.g. a synthetic clay is present in favour of pressure resistance.

Moreover protective antistress layers may be coated as two adjacent layers, wherein one or both can be provided with at least one compound according to the general formula (I). It is however understood that in a preferred embodiment said the layer coated adjacent to the emulsion layer should include such a compound. Protective antistress layers, besides their function as protection layer may include compounds providing better antistatic properties has been disclosed e.g. in EP-A 0 644 454 (with polyoxyalkylene compounds as antistatic agents), in EP-A's 0 505 626, 0 534 006 and 0 644 456. As said layers are in most cases outermost layers their contribution to satisfactory surface characteristics of the processed film material is very important, e.g. from the point of view of an excellent surface glare as desired by examining medecins, as has been described in EP-A 0 806 705 and in EP-Application No. 98203412, filed Oct. 8, 1998.

When a antihalation undercoat is present, as described in e.g. U.S. Pat. Nos. 5,077,184 and 5,693,370 the said compound according to the formula (I) is advantageously present therein, particularly if the said compound would be absent in the protective antistress layers for whatever a reason and may be present therein if the said compound is present in the said protective antistress layers.

It has been established now that the presence of compounds satisfying formula (I) in one or more non-light-sensitive layers (like the protective antistress layers and/or antihalation undercoat layers) adjacent to the light-sensitive silver halide emulsion layers of the radiographic material of the present invention further improves image tone in that a "colder"blue-black image is obtained as desired by medecins examining radiographs for at least the same, and even an increased, covering power.

The light-sensitive (photosensitive) layers of the radiographic film material of the present invention coated on each of the major surfaces of the subbed support, optionally provided with a antihalation undercoat, thus contain chemically and spectrally sensitized {111} tabular hexagonal silver halide emulsion grains or is crystals in an amount of at least 50%, more preferably at least 70% and most preferably at least 90% of the total projective surface of all grains, wherein the said tabular grains have a mean equivalent volume diameter of from 0.3 μm up to 1.0 μm and an average grain thickness of less than 0.30 μm, and more preferably from 0.05 μm up to 0.25 μm, wherein said film material is coated with a total amount of silver halide, expressed as an equivalent amount of silver nitrate of less than 7 g/m2, more preferably from 3.0 up to 6.0 g/m2.

Average grain volumes can be determined from calculations, after measurement for each individual grain of its volume determined after having applied electrochemical reduction techniques, wherein electrical signals thus obtained are related with silver halide grain volumes after total reduction thereof to metallic silver at the cathode of an electrochemical cell. The percentage of the total projective area of all tabular grains with respect to the total projective area of all grains present in the emulsion is calculated from electron microscopic photographs. Average grain diameters and thicknesses of the tabular grains are calculated after determination of individual grain thickness and diameter, calculated as equivalent circular diameter of the hexagonal surface, from shadowed electron microscopic photographs or scanning electron microscopic photographs. From the average ratios of (equivalent circular) diameter to thickness for each individual tabular grain aspect ratios are determined in order to get ability to further calculate the mean aspect ratio of the tabular grains in the emulsion distribution.

The silver halide emulsions are coated in at least one light-sensitive layer on at least one side of a transparent film support having first and second major surfaces coated on each of the said major surfaces of the support, at least one photosensitive layer overcoated with a protective antistress layer, said photosensitive layer containing a tabular grain emulsion having tabular hexagonal core-shell emulsion grains or crystals in an amount of at least 50% of the total projective grain surface of all grains, said grains being composed of a silver bromide core and a silver bromoiodide shell having an average amount over the whole crystal volume of more than 90 mole % of silver bromide, said grains having a mean equivalent volume diameter of from 0.3 μm up to 1.0 μm and an average grain thickness of less than 0.30 μm, and more preferably less than 0.25 μm (e.g. from 0.05 μm up to 0.23 μm), and wherein said film material is coated with a total amount of silver halide, expressed as an equivalent amount of silver nitrate of less than 7 g/m2, more preferably from 3.0 up to 6.6 g/m2. Typical for a core-shell structure as present in the tabular hexagonal grains of the present invention is that at least two regions having a differing silver halide composition are present in the grain volume: the inner core is composed of silver bromide, thus free of iodide, while the outermost shell corresponding with at most 20% of all silver halide precipitated has a silver bromoiodide composition, thus having silver iodide in an amount in order to get an average amount amount of less than 1 mole % of iodide, based on silver, over the whole crystal volume of the tabular hexagonal grains in the material of the present invention.

In a more preferred embodiment said tabular grains have all silver iodide present on the grain surface thereof in an amount in order to get an average amount of silver iodide over the whole grain volume of from 0.1 mole % up to less than 1 mole %, based on silver; and even more preferred in order to get an average amount of silver iodide of from 0.1 mole % up to 0.4 mole %.

Not only in favour of image tone as set forth in the objects of the present invention but also in favour of developability it is an essential feature to have an amount of iodide in the outermost shell of the tabular grains, and even more preferred, at the grain surface of the tabular grains in order to get an average amount of iodide over the whole grain volume of less than 1 mole % based on silver, and even most preferred an average amount of iodide of 0.1 mole % up to 0.4 mole %.

The radiographic film material according to the present invention comprises light-sensitive layers at both-sides of the film support wherein {111} tabular silver halide grains rich in silver bromide (having aat least 90 mole % of silver bromide, based on silver) and containing silver iodide in the limited amounts as set forth hereinbefore in the outermost shell representing at most 20% of all silver halide precipitated, and more preferred at the grain surface. Said grains have an average aspect ratio of 5 or more, preferably in the range from 5 to 20, an average grain thickness of less than 0.30 μm, more preferably less than 0.25 μm, and account for at least 50% (more preferably at least 70% and even most preferably at least 90%) of the total projective area of all grains. More preferably said grains having an average aspect ratio of from 5 up to 20, have an average grain thickness of e.g. 0.06 μm up to 0.23 μm. In a further preferred embodiment the {111} tabular hexagonal grain population making part of a light-sensitive emulsion is homogeneous, i.e., has a variation coeffient of less and 0.40 and more preferably even from 0.10 up to 0.30, based on the equivalent circular diameters calculated for the individual {111} tabular grains.

Preparation methods for {111} tabular grain emulsions rich in silver bromide suitable for use with respect to tabular grains in materials of the present invention can be found in Research Dislosure No. 389057,p. 591–639 (1996), more particularly in Chapter I. A very useful method has e.g. been described in EP-A 0 843 208. Said {111} tabular hexagonal crystals rich in silver bromide are thus composed of silver bromoiodide or silver bromochloroiodide (with less than 10 mole % of silver chloride, based on silver). Iodide ions added during precipitation of the last amount of at most 20% of all precipitated silver halide or, in an even more preferred embodiment, at the surface of al {111} tabular hexagonal grains, are provided in the preparation method by addition of an inorganic iodide salt as potassium iodide. More preferred as providing slower liberation of iodide in the reaction vessel is addition of organic agents releasing iodide ions in order to provide the low silver iodide concentrations, not exceeding 1 mole % and even more preferably not exceeding the range from 0.1 mole % up to 0.4 mole % based on silver and calculated as an average value over het whole grain volume. Addition of iodide by organic agents releasing iodide ions has been described e.g. in EP-A's 0 561 415, 0 563 701, 0 563 708 and 0 651 284 and in U.S. Pat. Nos. 5,482,826 and 5,736,312. In an alternative method iodide ions can be released from iodate as has been described in U.S. Pat. No. 5,736,312. Release of iodide in the presence of a compound adjusting the rate of iodide release can be applied as described in U.S. Pat. No. 5,807,663.

In another preferred embodiment addition of iodide to emulsion grains rich in silver bromide is performed by adding fine preformed grains of silver iodide, whether or not including bromide and/or chloride in minor amounts, said grains having a grain diameter of not more than 100 nm, and ,more preferably, not more than 50 nm. Such fine grains are so-called "Lippmann" emulsions. Addition of iodide making use from such fine grains rich in silver iodide (or even pure silver iodide) has been described for the preparation of {111} tabular grains in JP-A's 04251241 and 08029904 and in EP-A's 0 662 632 and 0 658 805, wherein an outermost phase rich in silver iodide has been added to {111} tabular grains rich in silver bromide (optionally comprising up to less than 10 mole % of silver chloride). Addition of fine AgI-Lippmann emulsions to the surface of the silver halide crystals in order to get a global iodide content of less than 1 mole % in the grain may advantageously proceed as disclosed in EP-A 0 475 191, wherein an excellent speed/fog ratio and a high covering power are attained.

Preparation of {111} tabular grain emulsions is performed in the presence of gelatin or colloidal silica sol as a binder providing colloidal stability during all preparation steps.

In one embodiment the precipitation of the tabular silver halide crystals according to the present invention is performed in the presence of a protective, hydrophilic colloid, e.g. conventional lime-treated or acid treated gelatin but also oxidized gelatin (see e.g. EP-A 0 843 208) or a synthetic peptizer may be used. The preparation of such modified gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains it is common practice to establish a gelatin concentration of from about 0.05% to 5.0% by weight in the dispersion medium.

In another embodiment tabular silver halide grains used in emulsions according to the present invention are precipitated in the absence of gelatin by using colloidal silica sol as a protective colloid in the presence of an onium compound, preferably a phosphonium compound, as has been described in EP-A 0 677 773.

In order to control the grain size, beside dyes (even spectral sensitizing dyes e.g.) or crystal habit modifiers, other grain growth restrainers or accelerators may also be used during the precipitation, together with the flow rate and/or concentration variations of the silver and halide salt solutions, the temperature, pAg, physical ripening time, etc. Silver halide solvents such as ammonia, a thioether compound, thiazolidine-2-thione, tetra-substituted thiourea, potassium or ammonium rhodanide and an amine compound may be present during grain precipitation in order to further adjust the average grain size.

At the end of the precipitation the emulsion is made free from excess of soluble inorganic salts by a conventional washing technique e.g. flocculation by ammonium sulphate or polystyrene sulphonate, followed by one or more washing and redispersion steps. Another well-known washing technique is ultrafiltration or diafiltration. Finally, extra gelatin is added to the emulsion in order to obtain a gelatin to silver ratio which is optimized with respect to the coating conditions and/or in order to establish the required thickness of the coated emulsion layer. Preferably a gelatin to silver halide weight ratio ranging from 0.3 to 1.0 is then obtained.

It is clear that {111} tabular silver halide emulsion grains, present in light-sensitive emulsion layers of materials according to the present invention, are, besides spectrally sensitized, also chemically sensitized, at least with a combination of labile sulphur compounds and gold compounds, more preferably with compounds providing sulphur, selenium (without even excluding tellurium) and gold.

Chemical sensitization methods for {111} tabular grain emulsions rich in silver bromide can be found in Research Dislosure No. 389057, p. 591–639 (1996), more particularly in Chapter IV. Very useful methods related therewith have been disclosed in EP-A's 0 443 453, 0 454 069, 0 541 104 and in U.S. Pat. Nos. 5,112,733 and 5,654,134. Useful labile selenium compounds have been disclosed in EP-A's 0 831 363, 0 889 354 and 0 895 121. Said labile selenium compounds are commonly applied in combination with sulphur and gold, and so are labile tellurium compounds as has been disclosed e.g. in EP-Application No. 99202439, filed Jul. 23, 1999.

The {111} tabular silver halide emulsion grains, present in light-sensitive emulsion layers of materials according to the present invention, are spectrally sensitized in the blue to near ultraviolet wavelength range and/or green wavelength range, depending on the requirements as set forth by medecins examining radiological images as especially sharpness (low cross-over percentage), but also contrast (which should be a "dedicated contrast" depending on the density range wherein image details should be discernable), speed and density range.

Preparation of spectrally and chemically sensitized tabular grains as may be applied to emulsion grains to be coated light-sensitive layers of a radiographic material according to the present invention has been described in U.S. Pat. No. 4,439,520, wherein it has been established to perform spectral sensitization before chemical sensitization, so that the spectral sensitizer acts as a site-director for the sensitivity specks, generated during chemical sensitization. A broad review about spectral sensitization can be found in in Research Dislosure No. 389057, p. 591–639 (1996), more particularly in Chapter V. Further useful information about additives which may be used in order to prepare emulsions to be coated in a material according to the present invention can be found in Research Dislosure No. 389057, p. 591–639 (1996), as in Chapter VII about antifoggants and stabilizers, in Chapter VIII about coating physical property modifying addenda, in Chapter XI about layer arrangements and in Chapter XV about supports.

In one embodiment according to the present invention the duplitized film material comprises light-sensitive emulsion layers coated on both sides of a subbed support (i.a. a support coated with good adhesion providing subbing layers) with, optionally, inbetween said subbing layers and the light-sensitive layers coated thereupon, a hydrophilic non-light-sensitive layer, e.g. comprising antihalation dyes providing less cross-over and thus a better sharpness as described e.g. in U.S. Pat. Nos. 5,344,749; 5,478,708; 5,811,545 and 5,811,546. Said light-sensitive layers present in the material according to the present invention further comprise, in one embodiment, an emulsion having {111} hexagonal tabular grains rich in silver bromide, spectrally sensitive to irradiation in the wavelength range shorter than 420 nm by the presence of at least one J-aggregating zeromethine blue spectral sensitizer (preferred sensitizers according to the formulae (I.1) and (I.2) being given hereinafter) and of at least one dye selected from the group consisting of azacyanine dyes and monomethine cyanine dyes, corresponding to the formulae (II) and (III) respectively as described hereinafter. The material according to the present invention thus has grains which have been made sensitive to the ultraviolet and/or blue range of the wavelength spectrum.

A blue/ultraviolet absorbing dye combination of zeromethine dyes with monomethine or azacyanine sensitizing dyes absorbing blue/UV-radiation as described in EP-Application No. 99201189.0, filed Apr. 16, 1999 is particularly suitable for use when the radiographic material according to the present invention is applied in combination with a blue/UV-intensifying screen. Besides the favourable diagnostic value with respect to image quality thanks to a low fog level, a high overall contrast, an enhanced sharpness (low cross-over percentage) and absence of residual color, even in rapid processing cycles, as described therein, a particularly good image tone is provided offering cold black-bluish images as desired by the examiners, according to the objects of the present invention.

In the radiographic film material according to the present invention said film thus further comprises as spectrally sensitizing dye for the {111} tabular silver bromoiodide or silver bromo(chloro)iodide grains in order to make them spectrally sensitive to irradiation in the said wavelength range shorter than 420 nm at least one dye according to the general formula given in EP-A 0 712 034, from which particularly preferred blue/near ultraviolet-sensitizing J-aggregating sensitizing dyes have been given in the formulae (II.1) and (II.2) hereinafter, and at least one dye selected from the group consisting of monomethine cyanine dyes and azacyanine dyes.

(II.1)

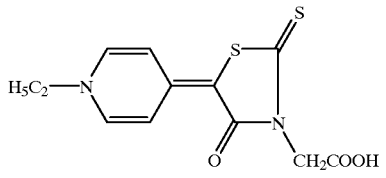

5-(1-ethyl-4(1H)-pyridylene)-4-oxo-2-thioxo-3-thiazolidine acetic acid (II.2)

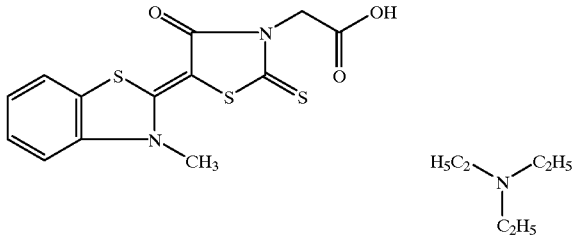

5-(3-methyl-3(3H)-benzothiazolylidene)-4-oxo-2-thioxo-3-thiazolidine acetic acid As is clear the J-aggregating blue-sensitizing dye or dyes, and more preferably the zeromethine dyes according to the formulae (II.1) and (II.2) may be present alone, but are preferably present besides at least one dye selected from the group consisting of azacyanine dyes (the formulae of which are given hereinafter under the formulae III) and monomethine cyanine dyes further given hereinafter (see formulae IV) in order to reach the objects of the present invention, thereby reducing dye stain after processing and improving speed moreover provide a suitable image tone if applied as spectrally sensitizing combination to the {111} hexagonal tabular silver bromoiodide grains having all silver iodide at their grain surface in the claimed amounts of less than 1 mole %, based on silver over the whole grain volume.

Specific azacyanine dyes particularly suitable for use in the emulsions, materials and in the film-screen system-according to the present invention are following, according to the formulae (III.1) and (III.2):

(III.1)

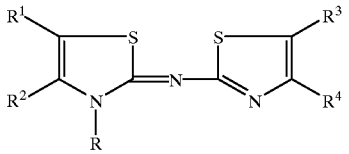

(III.2)

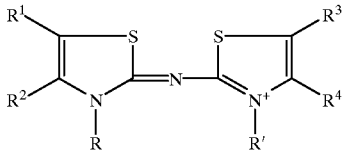

wherein each of the substituents R1–R4 independently represents hydrogen, an (unsubstituted or substituted) alkyl, an (unsubstituted or substituted) aryl or an (unsubstituted or substituted) aralkyl;

wherein R1 and R2 and/or R3 and R4 may form a (substituted or unsubstituted) benzoring, which, if substituted, has the same or different substituents as R1–R4;

wherein R represents an (unsubstituted or substituted) alkyl, an (unsubstituted or substituted) aryl or an (unsubstituted or substituted) aralkyl group;

wherein R' represents hydrogen, an (unsubstituted or substituted) alkyl, an (unsubstituted or substituted) aryl or an (unsubstituted or substituted) aralkyl group;

and wherein cations or anions are present as charge compensating ions.

More particularly each of R and R' independently represents (CH2)nH or (CH2)nOH, n being an integer having a value from 1 to 4, (CH2)m(SO3—) or (CH2)mO(SO3—), m being an integer having a value from 2 to 4, (CH2)2CH(Y)SO3— wherein Y represents CH3—, —Cl or —OH;

(CH2)mN(R)SO3— or (CH2)mN(R')SO3—

(CH2)n(COO—) or (CH2)n(COOH), (CH2)sSO2—(CH2)tH wherein s equals 2 or 3 and t equals 1 or 2;

(CH2)x-Phen-W, wherein W represents —COO— or SO3—; Phen represents phenyl which is substituted or unsubstituted; and x equals 1, 2, 3 or 4, (CH2)nCONHSO2R or (CH2)nCONHSO2R', provided that R' may represent hydrogen as set forth hereinbefore or a latent solubilizing group as, e.g., (CH2)m—(C═O)—O—CH2—(C═O)—CH3, wherein m' is an integer having a value of from 1 to 5.

In order to get neutral azacyanine structures preferred charge compensating cations are Li+, Na+, K+, HN+Et3, wherein Et represents ethyl, whereas preferred charge compensating anions are Cl—,Br—, I—, —OTos, —OMes, CF3SO3—, wherein —OTos represents tosylate and —OMes represents mesylate.

Typical examples of azacyanines are those, given under the formulae (III.3–III.13) hereinafter:

(III.3)

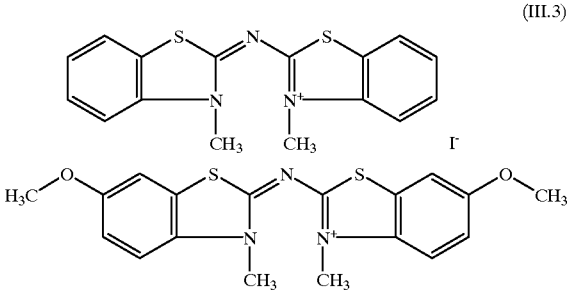

(III.4)

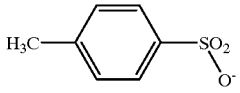

-continued

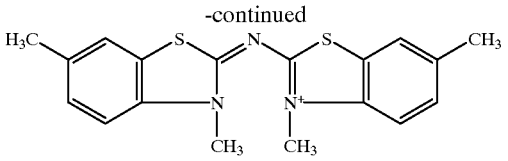

(III.5)

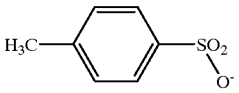

(III.6)

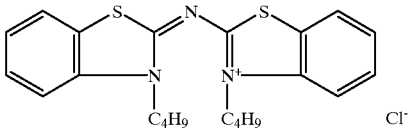

(III.7)

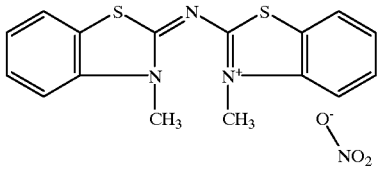

(III.8)

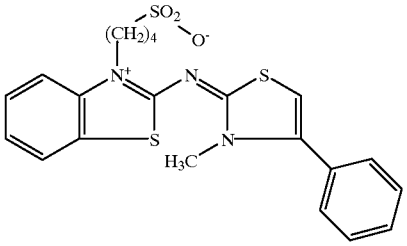

(III.9)

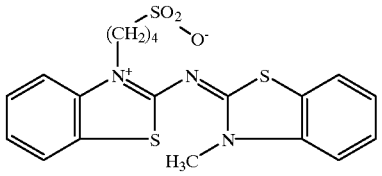

(III.10)

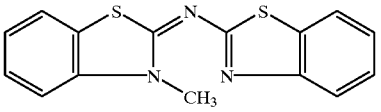

(III.11)

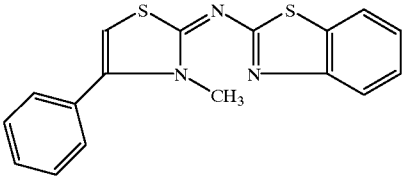

(III.12)

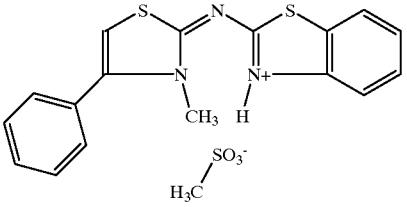

-continued (III.13)

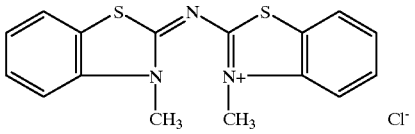

Preferred (non-J-aggregating) monomethine cyanine dyes already mentioned hereinbefore, as an alternative for the (non-J-aggregating) azacyanine dyes according to the formulae (III.1–III.2), are represented by the general formula (IV):

(IV)

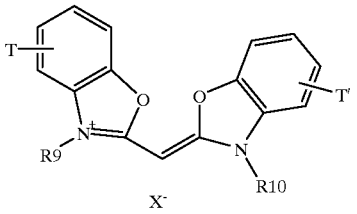

wherein each of R9 and R10 independently represents a substituted or unsubstituted C1–C5 alkyl chain, or a substituted or unsubstituted (five- or six-membered) aromatic ring, provided that at least one of R9 and R10 has a solubilizing group or a latent solubilizing group;

wherein T and T' each independently represents a substituted or unsubstituted alkyl, a substituted or unsubstituted aryl or a substituted or unsubstituted heterocyclic group and wherein X is an anion, providing electrical neutrality.

More preferably each of R9 and R10 independently represents (CH2)n"H or (CH2)n"OH, n" being an integer having a value from 1 to 4, (CH2)m"(SO3—) or (CH2)m"O(SO3—), m" being an integer having a value from 2 to 4, (CH2)2CH(Y")SO3— wherein Y" represents CH3—, —Cl or —OH;

(CH2)m"N(R)SO3— or (CH2)m"N(R')SO3—

(CH2)n"(COO—) or (CH2)n"(COOH), (CH2)n"CONHSO2R or (CH2)n"CONHSO2R', wherein R and R' have the same meaning as explained hereinbefore and wherein X is an anion, providing electrical neutrality of the molecule;

(CH2)n"(COO—) or (CH2)n"(COOH), (CH2)s"SO2—(CH2)t"H wherein s" equals 2 or 3 and t" equals 1 or 2;

(CH2)x"-Phen-W", wherein W" represents —COO— or SO3—; Phen represents phenyl which is substituted or unsubstituted; and x" equals 1, 2, 3 or 4; a latent solubilizing group as, e.g., (CH2)m'"—(C═O)—O—CH2—(C═O)—CH3, wherein m'" is an integer having a value of from 1 to 5 or (CH2)n"CONHSO2R or (CH2)n"CONHSO2R', provided that R' may represent hydrogen as set forth hereinbefore.

When T and/or T' represent(s) a substituted or unsubstituted heterocyclic group, said heterocyclic group may be a saturated or unsaturated five membered or six membered ring, whether or not conjugated with a benzene ring. More particular general structures according to the general formula (IV), without being exhaustive therefor, are given hereinafter in the formulae (IV.1)–(IV.6).

(IV.1)

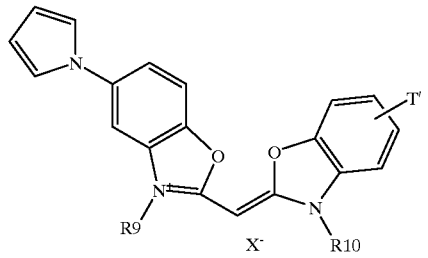

(IV.2)

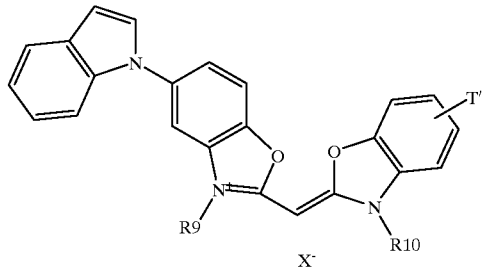

(IV.3)

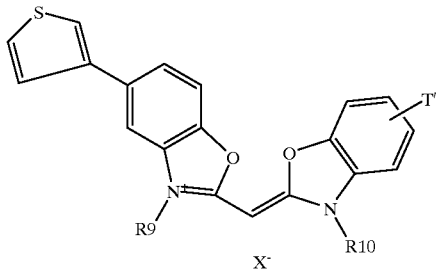

(IV.4)

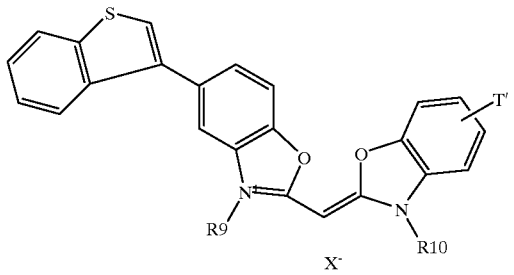

(IV.5)

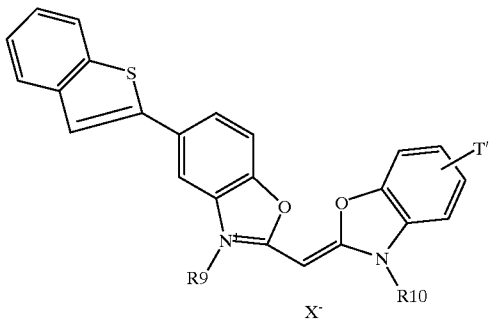

-continued (IV.6)

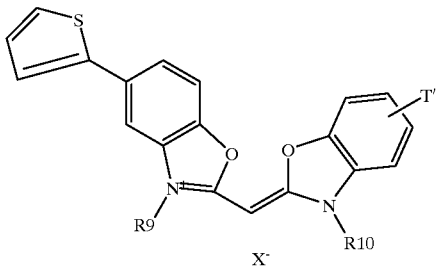

Particularly preferred monomethine cyanine dyes for use in emulsions coated in light-sensitive layers of the material used in the film/screen system of the present invention correspond to the formula (IV.7) or (IV.8), represented hereinafter:

(IV.7)

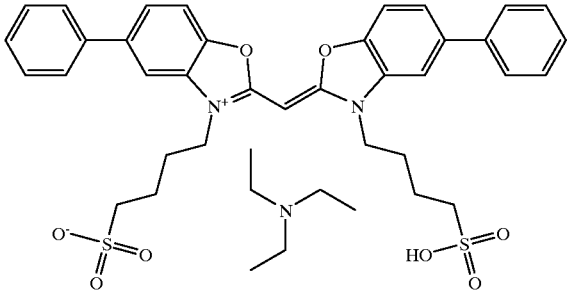

(IV.8)

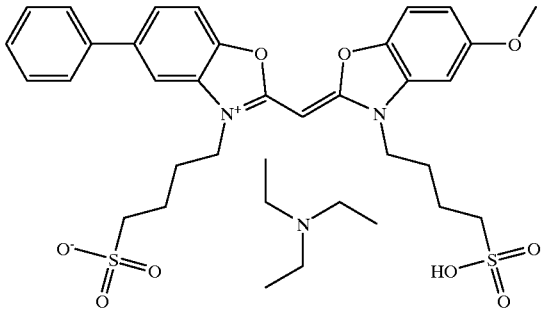

Said blue-sensitizing dye or dyes are added as first dye during the chemical ripening procedure, before addition of the chemical ripening compounds or agents. Mixtures of blue sensitizing dyes according to formula (III) wherein Q is S for one dye and O for the other are particularly interesting from the point of view of an increased spectral response in form of speed, which can be achieved at lower total amounts of dyes as becomes clear from U.S. Pat. No. 5,707,794.

In another embodiment the material according to the present invention has grains which have been made sensitive to the green range of the wavelength spectrum. The radiographic film material as claimed thus has at least one emulsion comprising hexagonal {111} tabular silver halide grains rich in silver bromide (silver bromoiodide or silver bromochloroiodide), spectrally sensitive to irradiation in the wavelength range between 500 and 555 nm by the presence of at least one J-aggregating spectrally sensitizing trimethine cyanine dye according to the general formula given in EP-A 0 678 772 and 0 953 867, wherein e.g. trimethine benzoxazoles and imidazoles are used apart or in combination, and of at least one dye selected from the group consisting of monomethine cyanine dyes and azacyanine dyes according to the formulae (IV.1–IV.8) and (III.1–III.2) respectively, the film perfectly matches with the screen emitting said radiation in the green wavelength range with a maximum in the range from 530–555 nm as in a preferred embodiment of the present invention absorption of radiation in the preferred green wavelength range by the {111} tabular silver halide grains rich in silver bromide is corresponding with at least 50% and more preferably at least 80% of the total radiation absorption by the said grains.

Therefore in a preferred embodiment radiation-sensitive emulsions having silver bromoiodide or silver bromochloroiodide grains, as in the present invention, sensitive to irradiation in the wavelength range between 530 and 555 nm, are made sensitive thereto by the presence of a J-aggregating spectrally sensitizing cyanine dye. Particularly preferred (orthochromatic) spectral sensitizers or dyes are the J-aggregating oxacarbocyanine dyes anhydro-5,5'-dichloro-3,3'-bis(n-sulpho-butyl)-9-ethyloxacarbocyanine hydroxide and anhydro-5,5'-dichloro-3,3'-bis(n-sulphopropyl)-9-ethyloxacarbocyanine hydroxide. Furthermore green-light absorbing spectral sensitizers according to the formulae given in JP-A's 06,035,104; 06,035,101; 06,035,102; 62,191,847; 63,249,839; 01,312,536; 03,200,246; U.S. Pat. No. 4,777,125 and DE 3,819,241 may be used. The right choice of said sensitizers or combinations thereof is always related with the purpose of obtaining the highest possible photographic speed while reducing possible dye stain, due to the use of huge amounts of dyes after processing, especially in rapid processing cycles.

As it is a particularly favourable aspect for materials coated from emulsions having tabular grains in general, and more specifically for materials according to the present invention coated from emulsions having tabular hexagonal {111} tabular grains to be coated with lower amounts of silver without loss of covering power in the material, the total amount of silver halide coated in said film material, expressed as an equivalent amount of silver nitrate, is less than 7.0 g/m2, preferably in the range from 3.0 to 6.6 g/m2.

Said duplitized film materials for use in radiographic applications are irradiated by the light emitted imagewise by X-ray intensifying screens after conversion of X-ray radiation to the said light by luminescent phosphors coated in the said screens or panels, in intimate contact therewith at both sides of the coated film support during X-ray exposure of part of a patient. A diagnostic silver image, in conformity with the X-ray image, is obtained after processing of the said film material. For use in common medical radiography (projection radiography) the X-ray film material comprises a transparent film support, coated on both sides with at least one silver halide emulsion layer, further overcoated with at least one protective antistress layer and, optionally, an afterlayer as disclosed e.g. in EP-A's 0 644 454 and 0 644 456. It is further preferable to add to the protective antistress layer(s), besides the normally added components a substituted 1-phenyl 5-mercaptotetrazole compound, preferably in huge amounts of at least 0.5 mmole per mole of coated silver, more preferably 1 mmole and even up to an amount 10 mmole. It has been established that the presence of such compounds in the protective antistress layer(s) further improves image tone in that a "colder" blue-black image is obtained for at least the same and even an increased covering power, with the remark that use of tetrazoles in the protective antistress layer is more effective when lower amounts of silver iodide are present at the grain surface of the {111} tabular grains.

During the X-ray irradiation said film is arranged in a cassette between two X-ray intensifying screens each of them making contact with its corresponding light-sensitive side, thus forming a film/screen system.

In one embodiment according to the present invention a radiographic screen/film combination or system has been provided comprising a duplitized film material, sandwiched between a pair of supported or self-supporting X-ray intensifying screens, characterized in that i) said pair of supported or self-supporting X-ray intensifying screens essentially consists of luminescent phosphor particles emitting at least 50% and more preferably at least 80% of their emitted radiation in the wavelength range shorter than 420 nm, as e.g. a niobium and gadolinium doped, monoclinic M, yttriumtantalate (MYT) phosphor or a calcium tungstate phosphor;

ii) said film comprises {111} tabular silver halide grains rich in silver bromide, spectrally sensitive to irradiation in the said wavelength range shorter than 420 nm by the presence of at least one J-aggregating blue spectral sensitizer (e.g. a zeromethine sensitizer according to e.g. the formula (II.1) or (II.2)) and of at least one of the non-J-aggregate forming dyes selected from the group consisting of azacyanine dyes and monomethine cyanine dyes according to the formulae (III.1–III.2) and (IV) [(IV.1)–(IV.8) as more preferred structures] respectively, given hereinbefore in the description, wherein said emulsion is present in at least one light-sensitive emulsion layer on at least one side of the film support of the radiographic material of the present invention.

As the radiographic film material as claimed has as least one emulsion comprising {111} tabular silver halide grains rich in silver bromide, spectrally sensitive to irradiation in the wavelength range shorter than 420 nm by the presence of at least one spectrally sensitizing dye according to the formula (II) and of at least one dye selected from the group consisting of monomethine cyanine dyes and azacyanine dyes according to the formulae (IV) and (III) respectively, the film perfectly matches with the screen emitting said radiation in the wavelength range shorter than 420 nm as in a preferred embodiment of the present invention absorption of radiation in the said wavelength range shorter than 420 nm by the {111} tabular silver bromo(chloro)iodide grains is corresponding with at least 50% and more preferably at least 80% of the total radiation absorption by the said grains.

Luminescent phosphors suitable for use in a conventional intensifying screen of a radiographic film/screen system as the one according to the present invention must have a high prompt emission of fluorescent light on X-ray irradiation and low afterglow in favour of image sharpness. The relationship between resolution and speed of X-ray intensifying screens is described e.g. in Med. Phys. 5(3), 205 (1978). Specific intensifying screens emitting ultraviolet-blue radiation have e.g. been disclosed in U.S. Pat. Nos. 4,225,653; 4,387,141; 4,710,637; 5,112,700; 5,173,611 and 5,432,351; in EP-A's 0 650 089; 0 658 613; in PCT-Applications WO 93/11457 and WO 95/15514. Typical blue-UV emitting phosphors therein are tantalates as described in PCT-Applications WO 93/1521 and 93/1522, hafnates as described in U.S. Pat. No. 5,173,611 and fluorohalides (fluorobromides) of barium and strontium as in WO 91/1357 and U.S. Pat. No. 5,629,125, doped with europium and co-doped with samarium as in U.S. Pat. Nos. 5,422,220 and 5,547,807 and even mixtures of tantalates and fluorohalides as in U.S. Pat. No. 5,077,145 and EP-A 0 533 234, replacing CaWO4 as representative for an older well-known generation of luminescent phosphors. Very useful phosphor particles have e.g. been disclosed in EP-A 0 820 069 wherein particles of niobium doped, monoclinic M, yttriumtantalate phosphor and particles of an europium doped bariumfluorohalide phosphor are composing the screen.

In the film/screen system according to the present invention preferred phosphor particles are niobium and gadolinium doped, monoclinic M, yttriumtantalate (MYT) phosphor corresponding to formula (V):

$$YTaO4:Gd:Nb \quad (V)$$

In another embodiment the radiographic film material has {111} tabular silver bromo(chloro)iodide emulsions spectrally sensitized with spectrally sensitizing dyes absorbing light in the green wavelength range.

In another embodiment according to the present invention a radiographic screen/film combination or system is thus provided comprising a duplitized film material, sandwiched between a pair of supported or self-supporting X-ray intensifying screens, characterized in that i) said pair of supported or self-supporting X-ray intensifying screens essentially consists of luminescent phosphor particles emitting at least 50% and more preferably at least 80% of their emitted radiation in the green wavelength range from 500 nm to 550 nm, as e.g. a terbium doped gadolinium oxisulfide phosphor;

ii) said film comprises {111} tabular silver halide grains rich in silver bromide, spectrally sensitive to irradiation in the said mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/for-maldehyde condensation products as described e.g. in U.S. Pat. No. 3,743,510 as well as cadmium salts and azaindene compounds.

At least one non-spectrally sensitizing dye can be added to an emulsion layer or to one or more non-light-sensitive hydrophilic layers such as an optionally present antihalation undercoat between the subbing layer and the emulsion layer as has e.g. been described in U.S. Pat. Nos. 5,077,184 and 5,693,370. The presence of such dye(s) in adapted amounts in an emulsion layer can even be recommended in order e.g. to adjust the sensitivity of the emulsion layer(s) or the required contrast, but also in order to reduce scattering of exposure radiation and thus to enhance sharpness. Preferred dyes are those that are removed easily from the photographic material during wet processing in order not to leave any residual color. When said dyes are added to the emulsion side, it may be preferred that these dyes are non-diffusible during coating of the hydrophilic layers. Examples of such dyes, without being limited thereto, are the dyes that have been described in e.g. U.S. Pat. Nos. 3,560,214; 3,647,460; 4,288,534; 4,311,787 and 4,857,446. These dyes may be added to the coating solution as a solid particle dispersion of water insoluble dyes having a mean particle diameter of less than 10 $\mu$m, more preferably less than 1 $\mu$m and still more preferably less than 0.1 $\mu$m. Examples of such dyes are disclosed in EP-A's. 0 384 633; 0 351 593; 0 586 748; 0 587 230 and 0 656 401, EP-A's. 0 323 729; 0 274 723 and 0 276 566, and in U.S. Pat. Nos. 4,900,653; 4,904,565; 4,949,654; 4,940,654; 4,948,717; 4,988,611; 4,803,150 and 5,344,749. Said dyes can also be added in form of a solid silica particle dispersion as disclosed in EP-A 0 569 074. Still another technique applied in order to obtain ultra fine dye dispersions consists in acidifying a slightly alkaline coating composition "in situ" just before coating it onto the supporting layer. A more recent review of dispersion methods, useful in the context of the present application has been described in EP-A 0 756 201. wavelength range from 500 to 550 nm by the presence of at least one J-aggregating green spectral sensitizer and of at least one the non-J-agregating dyes selected from the group consisting of azacyanine dyes and monomethine cyanine dyes, as respectively given hereinbefore in the formulae (III) and (IV), wherein said emulsion is present in at least one light-sensitive emulsion layer on at least one side of the film support.

In the context of the present invention, more particularly with respect to the purposes to get reduced dye stain besides an excellent image tone, said reduced dye stain delivering an indispensible asset thereto, azacyanine dyes according to the general formulae (III.1) and (III.2) are advantageously used in the preparation of {111} tabular grain emulsions as the presence of said dyes permits further addition of J-aggregating spectral sensitizers in lower amounts, without loss in speed, thereby providing better decoloration in the processing. A survey of other useful chemical classes of J-aggregating spectral sensitizers suitable for use in spectrally sensitizing emulsions of the present invention has been described by F. M. Hamer in "The Cyanine Dyes and Related Compounds", 1964, John Wiley & Sons and other examples specifically useful for spectral sensitization of tabular grains have been given in Research Disclosure Item 22534 and in addition a more recent overview has been given in EP-A 0 757 285, wherefrom dyes forming J-aggregates on the flat surface of the preferred silver bromide or silver bromoiodide crystals are particularly useful. It is moreover preferred that the radiation-sensitive emulsion used in the material according to the present invention has one or more azacyanine dye(s) and (a) J-aggregating spectrally sensitizing dye(s), whether providing spectral sensitivity in the blue/UV or in the green light range in a ratio amount of more than 1:4 for a grain coverage exceeding 50%.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are, i.a. heterocyclic The silver halide emulsions used in light-sensitive layers of the material according to the present invention may also comprise compounds preventing the formation of a high minimum density or stabilizing the photographic properties during the production or storage of photographic materials or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-B 77/031738 and GB-A 1,500,278, and 7-hydroxy-s-triazolo-[1,5-a]-pyrimidines as described in U.S. Pat. No. 4,727,017, and other compounds such as benzenethiosulphonic acid, benzenethio-sulphinic acid and benzenethiosulphonic acid amide.

Other compounds which can be used as fog-inhibiting compounds are those described in Research Disclosure No. 17643 (1978), Chaptre VI. These fog-inhibiting agents or stabilizers can be added to the silver halide emulsion prior to, during, or after the ripening thereof and mixtures of two or more of these compounds can be used.

The binder of the layers, especially when gelatin is used as a binder, can be forehardened with appropriate hardening agents such as those of the epoxide type, those of the ethylenimine type, those of the vinylsulfone type, e.g. 1,3-vinylsulphonyl-2-propanol or di-(vinylsulphonyl)-methane, vinylsulphonyl ether compounds, vinylsulphonyl compounds having soluble groups, chromium salts like e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

The photographic material according to the present invention may further comprise various kinds of surface-active agents in the light-sensitive emulsion layer(s) or in at least one other hydrophilic colloid layer. Suitable surface-active agents include non-ionic agents such as saponins, alkylene oxides, e.g., polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides, anionic agents comprising an acid group such as a carboxyl, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes, e.g. as coating aids, as compounds preventing electric charges, as compounds improving film transport in automatic film handling equipment, as compounds facilitating dispersive emulsification, as compounds preventing or reducing adhesion, and as compounds improving photographic properties such as higher contrast, sensitization and development acceleration. Especially when rapid processing conditions are important, development acceleration may be useful, which can be accomplished with the aid of various compounds, preferably polyoxyalkylene derivatives having a molecular weight of at least 400 such as those described in e.g. U.S. Pat. Nos. 3,038,805; 4,038,075 and 4,292,400. Especially preferred developing accelerators are recurrent thioether groups containing polyoxyethylenes as described in DE 2,360,878, EP-A's 0 634 688 and 0 674 215. The same or different or a mixture of different developing accelerators may be added to at least one of the hydrophilic layers at the emulsion side. It may be advantageous to partially substitute the hydrophilic colloid binder, preferably gelatin, of the light-sensitive silver halide emulsion layer or of an hydrophilic colloid layer in water-permeable relationship therewith by suitable amounts of dextran or dextran derivatives to improve the covering power of the silver image formed and to provide a higher resistance to abrasion in wet condition.

The photographic material of the present invention may further comprise various other additives such as compounds improving the dimensional stability of the photographic material, UV-absorbers, spacing agents, lubricants, plasticizers, antistatic agents, etc. Suitable additives for improving the dimensional stability are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids. Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

In general, the average particle size of spacing agents is comprised between 0.2 and 10 μm. Spacing agents can be soluble or insoluble in alkali. Alkali-insoluble spacing agents usually remain permanently in the photographic material, whereas alkali-soluble spacing agents usually are removed in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

Compounds which can be used as a plasticizer for the hydrophilic colloid layers are acetamide or polyols such as trimethylolpropane, pentanediol, butanediol, ethylene glycol and glycerine. Further, a polymer latex is preferably incorporated into the hydrophilic colloid layer for the purpose of improving the anti-pressure properties, e.g. a homopolymer of acrylic acid alkyl ester or a copolymer thereof with acrylic acid, a copolymer of styrene and butadiene, and a homopolymer or copolymer consisting of monomers having an active methylene group.

The photographic material according to the present invention may comprise an antistatic layer to avoid static discharges during coating, processing and other handling of the material. Such antistatic layer may be an outermost coating like the protective layer or an afterlayer or a stratum of one or more antistatic agents or a coating applied directly to the film support or other support and overcoated with a barrier or gelatin layer. Antistatic compounds suitable for use in such layers are e.g. vanadium pentoxide soles, tin oxide soles or conductive polymers such as polyethylene oxides (see e.g. EP-A 0 890 874) or a polymer latex and the like or polymers providing permanent antistatic properties as polyethylene dioxythiophenes (PEDT) described e.g. in U.S. Pat. No. 5,312,681; 5,354,613 and 5,391,472; and in EP-A 1 031 875.

During X-ray irradiation of the radiographic film material of the present invention said film material (made sensitive to green or blue light by suitable spectral sensitization of its light-sensitive emulsion grains) is arranged in a cassette with one X-ray intensifying screen (emitting green or blue light by suitable luminescent phosphors) making contact with the silver halide emulsion layer. For chest radiography said cassette is provided with two X-ray intensifying screens making contact with two X-ray intensifying screens, being the same or different. When two intensifying screens are used it is thus possible to use two identical screens (having same radiation sensitivity), to use two screens emitting the same irradiation but differing in speed, e.g. due to different coating amounts of phosphors (coating thickness), or even to use two intensifying screens having a different light emission. So combination of an intensifying screen sensitive to blue/UV-irradiation and a screen sensitive to green light may be favourable in order to attain desired properties with respect to sensitometry (desired sensitometric curve from the point of diagnostic view) and/or image quality (granularity and/or image definition, particularly sharpness).

Specific intensifying screens or conversion screens emitting green or blue light for use in the diagnostic image forming method according to the present invention are the commercially available X-ray generating devices providing an exposure to X-rays (e.g. with a tube voltage from 70 kV up to 100 kV—as in chest radiography—without however being limitative).

A preferred luminescent phosphor coated in the X-ray conversion screen used in a film/screen system sensitive to green light is Gd2O2S:Tb, emitting light in the wavelength range from 540 tot 555 nm. Said phosphor and its use in intensifying screens have been described extensively in patent literature, e.g. in U.S. Pat. Nos. 3,872,309; 4,130,429; 4,912,333; 4,925,594; 4,994,355; 5,021,327; 5,107,125 and 5,259,016 and in GB-Patent 1,489,398 and is suitable for use in the context of the film/screen system according to the present invention. The thickness of the phosphor layer therein depends on the amount of coated phosphor required in order to obtain the desired screen speed. X-ray intensifying screens used in the film/screen system according to the present invention can be self-supporting or supported. X-ray intensifying screens in the screen/film system according to the present invention generally comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto.

X-ray intensifying screens according the present invention can be self-supporting or supported. X-ray intensifying screens in accordance with the present invention generally comprise in order: a support (also called substrate), at least one layer comprising phosphor particles dispersed in a suitable binder and a protective coating coated over the phosphor containing layer to protect said layer during use. Further, a primer layer is sometimes provided between the phosphor containing layer and the substrate to closely bond said layer thereto. A plastic film is preferably employed as the support material. Depending on the speed class of the screens for which a synergistic effect should be attained in the relation between speed and sharpness, supports characterized by their reflectance properties, expressed as % reflectance over the wavelength range from 350 to 600 nm, are particularly used as described e.g. in U.S. Pat. No. 5,381,015. Such supports can be highly light reflecting as e.g. polyethylene terephthalate comprising a white pigment, e.g. BaSO4, TiO2, etc., or it can be light absorbing supports, e.g. polyethylene terephthalate comprising a black pigment, e.g.

carbon black. Supports comprising dyes or pigments that absorb light of a specific wavelength can also be useful in the preparation of X-ray intensifying screens in the film/screen system according to the present invention. In most applications the phosphor layers contain sufficient binder to give structural coherence to the layer. A mixture of two or more of these binders may be used, e.g., a mixture of polyethyl acrylate and cellulose acetobutyrate. The weight ratio of phosphor to binder is generally within the range of from 50:50 to 89:11, preferably from 80:20 to 89:11. The screen used in a screen/film system according to the present invention may comprise a supported layer of phosphor particles dispersed in a binding medium comprising one or more rubbery and/or elastomeric polymers as described in EP-A's 0 647 258 and 0 648 254. In this way a ratio by weight of pigment to binding medium of more than 90:10 and more preferably of at least 93:7, e.g. 98:2 can be obtained providing besides an excellent image resolution a high ease of manipulation as a result of a good elasticity of the screen and good adhesion properties between the support and the phosphor layer. Problems concerning staining of screens comprising said rubbery binder(s) may be overcome by the addition of known rubber anti-oxidation compounds. Screen structure mottle can be reduced, further providing a good relation between speed and image definition as disclosed in EP-A 0 758 012 and in the corresponding U.S. Pat. No. 5,663,005.

According to the present invention a method of image formation is further obtained by consecutively performing the steps of exposing to X-rays the radiographic screen/film combination or system described hereinbefore; followed by processing the film according to the present invention by the steps of developing, fixing, rinsing and drying.

The said processsing is preferably performed in an automatic processsing machine. More in detail for processing the film material of the present invention, preferably an automatically operating apparatus is used provided with a system for automatic replenishment of the processing solutions. The processing dry-to-dry within a short processing time of from 30 to 90 seconds and more preferably from 30 seconds to less than 60 seconds of materials coated from low amounts of silver is made possible by the steps of developing said material in a developer (preferably) without hardening agent; fixing said material in a fixer, optionally without hardening agent; rinsing and drying said material.

A normally used configuration in the processing apparatus shows the following consecutive tank units corresponding with, as consecutive solutions: developer-fixer-rinse water. Recent developments however have shown, that from the viewpoint of ecology and especially with respect to reduction of replenishing amounts, as consecutive solutions the sequence developer-fixer-fixer-rinse water-rinse water is preferred. One washing step between developing and fixation and one at the end before drying may als be present. As ecology and low replenishing amounts are main topics with respect to the present invention use is made of concentrated hardener free processing solutions in one single package. Examples thereof have been disclosed e.g. in U.S. Pat. Nos. 5,187,050 and 5,296,342. Especially preferred developers comprising ecologically acceptable developing agents such as ascorbic acid and derivatives thereof have been described in EP-A 0 732 619 and in U.S. Pat. Nos. 5,593,817 and 5,604,082. Instead of or partially substituting (e.g. in a ratio by weight of from 1:1 up to 9:1) the ecologically questionable "hydroquinone" (iso)ascorbic acid, 1-ascorbic acid and tetramethyl reductic acid are preferred as main developing agent in the developer. Said developing agents have further been described in EP-A's 0 461 783, 0 498 968, 0 690 343, 0 696 759, 0 704 756, 0 732 619, 0 731 381 and 0 731 382; in U.S. Pat. Nos. 5,474,879 and 5,498,511 and in Research Disclosure No 371052, published Mar. 1, 1995, wherein a more general formula covering the formula of said developing agents has been represented. In order to reduce "sludge formation" which is favored by solubilizing agents like sulphites, present in the developer as preservatives, a particularly suitable developer solution is the one comprising a reduced amount of sulphite and ascorbic acid which acts as a main developer and anti-oxidant as well and which is called "low-sludge" developer. Suitable measures taken therefore have recently been described in the EP-Applications Nos. 99201891 and 99201892, both filed simultaneously Jun. 14, 1999.

In favour of ecological fixation the presence of aluminum ions should be reduced, and more preferably, no aluminum ions should be present. This is moreover in favour of the absence of "sludge" formation, a phenomenon which leads to pi-line defects when high amounts of silver are coated in the light-sensitive layers. Measures in order to reduce "sludge-formation" have further been described in U.S. Pat. Nos. 5,447,817; 5,462,831 and 5,518,868. A particularly suitable fixer solution comprises an amount of less than 25 g of potassium sulphite per liter without the presence of acetic acid wherein said fixer has a pH value of at least 4.5, in order to make the fixer solution quasi odorless. If however aluminum ions are present in the fixer composition for whatever a reason, the presence of α-ketocarboxylic acid compounds is recommended as has been described in EP-A's 0 620 483 and 0 726 491 as well as in RD 16768, published March 1978. It is possible to use sodium thiosulphate as a fixing agent, thus avoiding the ecologically undesirable ammonium ions normally used. For low coating amounts of emulsion crystals rich in chloride a fixation time which is reduced to about 2 to 10 seconds can be attained. Moreover regeneration is kept to a minimum, especially in the processing of materials coated with reduced amounts of silver halide as in the present invention.

It is clear that although use of hexagonal {111} tabular emulsion grains in a duplitized radiographic material as in the present invention is claimed, it does however not exclude use of such {111} tabular hexagonal grain emulsions in single-side coated materials, whether or not in radiographic applications (such as in combination with a single screen having luminescent phosphors with a high prompt emission of fluorescent light on X-ray irradiation and low afterglow in favour of image sharpness used in mammography, wherefore the relationship between resolution and speed of X-ray intensifying screens has been described e.g. in Med. Phys. 5(3), 205 (1978)). Other single-side coated materials wherein the emulsions can advantageously applied, e.g. with respect to preservation properties, developability, etc. are black-and-white silver halide material used e.g. in micrography, in aviation photography, in black-and-white cinefilms, in laserfilms or hardcopy films and in graphic or reprographic applications. Even use thereof in light-sensitive layers of multilayered color materials may be useful.

EXAMPLES

While the present invention will hereinafter be described in connection with preferred embodiments thereof, it will be understood that it is not intended to limit the invention to those embodiments.

Example 1

Preparation of tabular emulsion A.

To a solution of 6.9 g of an oxidized gelatin in 3 1 of demineralized water at 51° C., adjusted to a pH of 2.5 by adding $H_2SO_4$, stirred up to a rate of 600 r.p.m., were added by a double jet method aqueous solutions of 0.98 M $AgNO_3$ (hereinafter referred to as A1) and 0.98 M KBr (hereinafter referred to as B1): 25 ml of A1 and 25 ml of B1 were added in a time interval of 30 seconds. During this period, the reaction mixture was maintained at 51° C. 2 minutes later, temperature was increased up to 70° C. over a period of 30 minutes. 1 minute later pH was set to a value of 5.0+0.3 and immediately thereafter a solution of 50 g of inert gelatin in 500 ml of demineralized water of 70° C. was added. 3 minutes later B1 was added at a rate of 7.06 ml/min. during 120 seconds, while simultaneously adding by double jet A1 at a rate of 7.5 ml/min. In a further double jet addition A1 and B1 were added during 2822 seconds at a linearly increasing rate going from 7.0 up to 21.11 ml/min. for A1 and from 7.06 up to 21.29 ml/min. in order to maintain a constant UAg potential of +40 mV in the reaction vessel. After 5 minutes A1 and B1 were simultaneously added by double-jet addition during 60 seconds at a rate of 10.0 and 10.04 ml/min. respectively whereby the UAg value was held at a constant value of 50 mV while increasing the running velocity up to a rate of 46.49 ml/min. and 46.69 ml/min. respectively over a total time period of 81 min. and 5 seconds.

After that double-jet addition period, an amount of an emulsion having ultrafine (ca. 0.040 μm) 100% AgI crystals, dissolved in 20 g of demineralized water at 40° C., was added to the reaction vessel in order to get a total AgI content at the end of precipitation of 0.1 mole % vs. silver precipitated.

The average grain size of the silver bromoiodide tabular {111} emulsion grains thus prepared, expressed as equivalent volume diameter, was 0.53 μm, the average thickness was 0.12 μm.

To 3442 g of this emulsion, of which pH was adjusted to 5.5, were added consecutively 4 ml of a 10 wt. % KSCN solution, 72 mg of the azacyanine dye corresponding with the formula (III.3) but with the tosylate anion of compound (III.5); 0.4 wt %), dissolved in 18 ml of methanol were added, followed by addition , after 5 minutes of 0.2 ml of a 4.76×10−3 M solution of sodium toluenethiosulphonate in methanol, further followed by addition after 5 minutes of 1200 ml of a 0.25 wt. % solution of anhydro-5,5'-dichloro-3,3'-bis(n-propyl-3-sulphonate)-9-ethyl-benzoxa-carbocyanine triethylammonium salt, 7.5 mg of sodium thiosulphate dissolved in 10 ml of demineralized water at 35° C., 8.5 ml of a 0.001 wt. % solution of 2-carboxyethyl-N-benzothiazine selenide, 18.5 ml of a solution containing 1.456×10−3 M chloro auric acid and 1.58×10−2 M ammonium rhodanide, and finally 10 ml of a 1 wt. % solution of 1-(p-carboxyphenyl)-5-mercapto-tetrazole. This mixture was chemically ripened during about 3 hours at 50° C. in order to get the best compromise between fog and sensitivity. After cooling phenol was added as a preservative.

Preparation of tabular emulsion B

To a solution of 5.5 g of an oxidized gelatin in 3 1 of demineralized water at 51° C., adjusted to a pH of 2.5 by adding H2SO4, stirred up to a rate of 600 r.p.m., were added by a double jet method aqueous solutions of 1.96 M AgNO3 (hereinafter referred to as A1) and 1.96 M KBr (hereinafter referred to as B1): 16 ml of A1 and 16 ml of B1 were added in a time interval of 30 seconds. During this period, the reaction mixture was maintained at 51° C. 6 minutes later pH was set to a value of 5.0+0.3 and immediately thereafter a solution of 50 g of inert gelatin in 500 ml of demineralized water of 70° C. was added. 6 minutes later B1 was added at a rate of 7.5 ml/min. during 28 seconds, followed during 1 minute by the simultaneous addition of A1 (at a rate of 7.5 ml/min.) and B1 (at a rate of 7.6 ml/min.). In a further double jet addition A1 and B1 were added during 2675 seconds at a linearly increasing rate going from 7.5 up to 15 ml/min. for A1 and from 7.6 up to 15.21 ml/min. in order to maintain a constant UAg potential of +10 mV in the reaction vessel. After 5 minutes A1 was added during 263 seconds at a rate of 7.5 ml/min. in order to increase the UAg value to 60 mV. At that moment a further double jet addition was performed for 100 seconds at a rate of 7.5 ml/min., whereafter the rate was increased linearly during 2518 seconds up to 36.8 ml/min. for A1 and up to 36.73 ml/min. for B1 in order to hold a constant UAg potential of +60 mV in the reaction vessel.

When said double jet addition was running 4 minutes an amount of an emulsion, dissolved in 20 g of demineralized water at 40° C., having ultrafine (ca. 0.040 μm) 100% AgI crystals was added to the reaction vessel in order to get a total AgI content at the end of precipitation of 0.1 mole % vs. silver precipitated.

After a physical ripening time of 20 min. stirring was ended in the reaction vessel.

The average grain size of the silver bromoioide tabular {111} emulsion grains thus prepared, expressed as equivalent volume diameter, was 0.57 μm, the average thickness was 0.16 μm.

To 3370 g of this emulsion, of which pH was adjusted to 5.5, were added consecutively 4 ml of a 10 wt. % KSCN solution, 0.2 ml of a 4.76×10−3 M solution of sodium toluenethio-sulphonate in methanol, 1200 ml of a 0.25 wt. % solution of anhydro-5,5'-dichloro-3,3'-bis(n-propyl-3-sulphonate)-9-ethyl-benzoxa-carbocyanine triethylammonium salt, 7 mg sodium thiosulphate dissolved in 10 ml of demineralized water, followed 1 minute later by addition of 8 ml of a 0.001 wt. % solution of 2-carboxyethyl-N-benzothiazine selenide, 3 minutes later: 6.5 ml of a solution containing 1.456×10−3 M chloro auric acid and 1.58×10−2 M ammonium rhodanide, and finally 10 ml of a 1 wt. % solution of 1-(p-carboxyphenyl)-S-mercapto-tetrazole and this mixture was chemically ripened during about 4 hours at 50° C. in order to get the best fog-speed relationship afterwards after coating in a photographic material. After cooling, phenol was added as a preservative.

Coating of the materials

Preparation of the film material

As stabilizers in the emulsion layer coatings 0.1 mmole of 1-(m-carboxymethylthioacetamido)-phenyl-5-mercaptotetrazole and 0.6 mmole of 5-methyl-1,2,4-triazolo-(1,5-A)-pyrimidine-7-ol were added per mole of silver. Resorcinol was added as hardener accelerator in an amount of 2.8 g per mole of Ag. Consecutively 0.5 g of polyglycol (MW=6000) was added as a development accelerator; 20 ml of polyoxyethylene surfactant H17C8-Phenyl-(O—CH2—CH2)8—O—CH2—COOH and in an amount of 140 mg (per mole of Ag) fluoroglucinol was added as a hardener stabilizer together with polymethyl acrylate latex (in an amount of 140% by weight, based on the amount of gelatin binder) which was used as a plasticizer. The thus prepared emulsion coating solutions were coated on a blue colored polyethylene terephthalate support (density of the support measured to be 0.200) in such an amount in order to give a coating weight of 2.75 g/m2 per side in terms of AgNO3 and 1.42 g of gelatin per m2 per side.

The following protective layer was coated thereupon (pH value: 6.25) at both sides:

| Composition of the protective antistress layer | |
|---|---|
| Gelatin | 1.11 g/m$^2$ |
| Graft copolymer (1) | 14 mg/m$^2$ |
| Chromium acetic acid | 7.3 mg/m$^2$ |
| Compound (2) | 16 mg/m$^2$ |
| Compound (3) | 6.7 mg/m$^2$ |
| Mobilcer Q (MMM trademarked product) | 9 ml/m$^2$ |
| Compound (4) | 15 mg/m$^2$ |
| Compound (5) | 40 mg/m$^2$ |

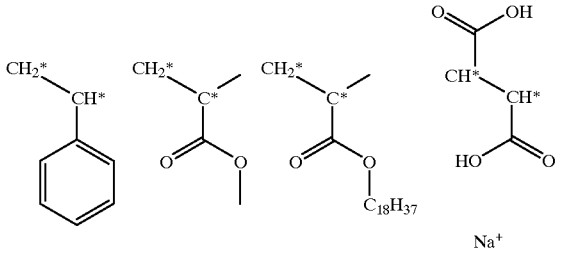

Compound (1)

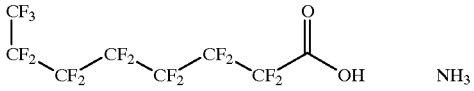

Compound (2)

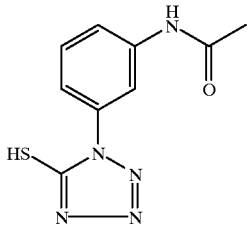

Compound (3)

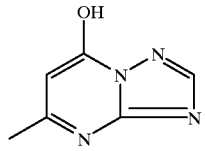

Compound (4)

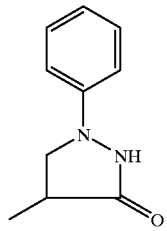

Compound (5)

Materials have been numbered from 1 to 5, material 1 representing a controll material, wherein Emulsion A was coated without 1-phenyl-5-mercaptotetrazole in the protective antistress layer and material 2 representing a comparative material wherein Emulsion B (having thicker tabular grains of 0.16 $\mu$m) was coated without 1-phenyl-5-mercaptotetrazole as well as in material 1, whereas the other materials Nos. 3–5 have been marked to be inventive examples, wherein amounts of 1-phenyl-5-mercaptotetrazole added were 12, 18 and 24 mg per m2 respectively.

Samples of these coatings were exposed with green light of 540 nm during 0.1 seconds using a continuous wedge and were processed The processing was run in the developer G138i, trademarked product from Agfa-Gevaert N. V., Mortsel, Belgium, followed by fixing in fixer G334i, trademarked product from Agfa-Gevaert N. V., Mortsel, Belgium, and rinsing at the indicated temperature of 35° C. for a total processing time of 45 seconds.

Sensitometric and other useful parameters given in Table 1 are

Fog "F", given as an integer after having multiplied the real fog density as measured with a factor of 1000;

Speed "S", given as an integer after having multiplied the sensitivity measured at a density of 1.00 above minimum density as measured with a factor of 100; —an decrease of speed with a figure of 30 corresponding with a doubling in speed—;

Covering power "CP", given as maximum density as measured after subtraction of the density of the suppport, multiplied with a factor of 100, further divided by the coating amount of silver, expressed as silver nitrate;

Image tone "IT", evaluated from figures corresponding with Dr, wherefore data are summarized with respect to the density Dr measured through a red filter at a blue density Db=2: the higher this value (figure multiplied by a factor of 100), the better (more desired blue-black instead of undesired red-brown) is the color of the developed silver.

TABLE 1

| Matl. No. | X mg PMT/m$^2$ | $AgNO_3$ (g/m$^2$) | F | S | CP | IT |
|---|---|---|---|---|---|---|
| 1 (controll) | 0 | 5.16 | 198 | 169 | 77 | 193 |
| 2 (comp.) | 0 | 5.19 | 208 | 140 | 73 | 195 |
| 3 (inv.) | 12 | 5.15 | 207 | 140 | 76 | 197 |
| 4 (inv.) | 18 | 5.20 | 205 | 141 | 76 | 198.5 |
| 5 (inv.) | 24 | 5.23 | 204 | 143 | 76 | 200 |

As becomes clear from the Table 1 a breakthrough in the classically expected relationship between covering power and image tone (thinner tabular grains provide a higher covering power but a worser image tone—see controll versus comparative—has been obtained as there is no longer a decrease in covering power when the more desired blue-black image tone is realized by addition in huge amounts of phenyl-mercaptotetrazole compounds in the protective antistress layer(s) of the material, said huge amounts not disturbing the desired sensitometry and, more particularly, speed.

For a suitable sensitometry—inclusive for a satisfactory sensitivity—a covering power as obtained for thinner grains and a blue-black image tone, better than expected as a function of the thickness of the tabular grains, is obtained.

Example 2

Preparation of tabular emulsion C.

To a solution of 7.5 g of an oxidized gelatin in 500 ml of demineralized water at 40° C., adjusted to a pH of 2.5 by adding H2SO4, stirred up to a rate of 500 rpm., were added by a double jet method aqueous solutions of 2.94 M AgNO3 (hereinafter referred to as A1) and 2.94 M KBr (hereinafter referred to as B1): 6 ml of A1 and 1.9 ml of B1 were added in a time interval of 30 seconds. During this period, the reaction mixture was maintained at 40° C. When the addition was completed, stirring continued during 60 seconds and the temperature was increased up to 70° C. over a period of 25 minutes. Immediately thereafter a solution of 25 g of inert gelatin in 100 ml of demineralized water of 70° C. was added. 6 minutes later ultrafiltration was started on-line in order to reduce the volume in the reaction vessel and in the ultrafiltration unit up to 1500 ml per 500 g of AgNO3 present therein. By double-jet addition B1 was added simultaneously with A1 (at a rate of 2.7 ml/min.) and B1 (at a rate of 2.71 ml/min.) during 2 minutes. In a further double jet addition A1 and B1 were added during 53 minutes and 45 seconds at a linearly increasing rate going from the initial rates mentioned herinbefore up to 9.90 ml/min. for A1 and up to 9.93 ml/min. for B1. After 5 minutes A1 and B1 were further added by double-jet during 50 minutes and 23 seconds at rates increasing up to 15.40 ml/min. and 15.45 ml/min. respectively. An emulsion, dissolved in 20 g of demineralized water at 40° C., having ultrafine (ca. 0.040 μm) 100% AgI crystals was added to the reaction vessel after precipitation of the {111} tabular hexagonal AgBr crystals in order to get a total AgI content at the end of precipitation of 0.1 mole % vs. silver precipitated. After a physical ripening time of 20 min. stirring was ended in the reaction vessel. Ultrafiltration on-line was ended and the temperature was decreased up to 45° C., while stirring was dcreased to 200 rpm. Washing during ultrafiltration (pressure 1.8 bar) was performed in order to obtain an end mV value (vs. sat. Ag/AgCl reference electrode) of +80 mV, concentrating the washed emulsion up to a volume of 690 ml per 500 g of AgNO3.

Peptisation was performed at 450C in order to obtain an emulsion having 250 g AgNO3 and 16.3 g of gelatin per kg.

The average grain size of the silver bromoioide tabular {111} emulsion grains thus prepared, expressed as equivalent volume diameter, was 0.60 μm, the average thickness was 0.23 μm.

To 3370 g of this emulsion, of which pH was adjusted to 5.5, were added consecutively 4 ml of a 10 wt. % KSCN solution, 0.2 ml of a 4.76×10−3 M solution of sodium toluenethio-sulphonate in methanol, 1200 ml of a 0.25 wt. % solution of anhydro-5,5'-dichloro-3,3'-bis(n-propyl-3-sulphonate)-9-ethyl-benzoxa-carbocyanine triethylammonium salt, 7 mg sodium thiosulphate dissolved in 10 ml of demineralized water, followed 1 minute later by addition of 8 ml of a 0.001 wt. % solution of 2-carboxyethyl-N-benzothiazine selenide, 3 minutes later: 6.5 ml of a solution containing 1.456×10−3 M chloro auric acid and 1.58×10−2 M ammonium rhodanide, and finally 10 ml of a 1 wt. % solution of 1-(p-carboxyphenyl)-5-mercapto-tetrazole and this mixture was chemically ripened during about 4 hours at 50° C. in order to get the best fog-speed relationship afterwards after coating in a photographic material. After cooling, phenol was added as a preservative. Same coating solutions were added as in Example 1 and coating, exposure and processing was also performed in the same way.

Sensitometric parameters, just as in Table 1 have been given hereinafter in the Table 2.

TABLE 2

| Matl. No. | x mg PMT/m$^2$ | $AgNO_3$ (g/m$^2$) | mole % AgI | F | S | CP | IT |
|---|---|---|---|---|---|---|---|
| B1 | 0 | 5.44 | 0.1 | 182 | 173 | 59 | 197 |
| B2 | 4.5 | 5.44 | 0.1 | 183 | 175 | 57 | 198 |
| B3 | 9.0 | 5.72 | 0.1 | 184 | 178 | 60 | 199 |
| C1 | 0 | 5.69 | 1.0 | 184 | 172 | 58 | 196 |
| C2 | 4.5 | 5.65 | 1.0 | 184 | 174 | 60 | 195 |

TABLE 2-continued

| Matl. No. | x mg PMT/m$^2$ | $AgNO_3$ (g/m$^2$) | mole % AgI | F | S | CP | IT |
|---|---|---|---|---|---|---|---|
| C3 | 9.0 | 5.88 | 1.0 | 183 | 175 | 59 | 196 |

As becomes clear from the data given in Table 2 there is no significant influence on image tone when an increasing amount of PMT is added to the protective antistress layers if the concentration of iodide is in the range of 1 mole % at the surface of the {111} tabular grains. Opposite thereto when silver iodide is present in an amount of 0.1 mole % based on silver (thus lower than 1 mole %, the range between 0.1 and 0.4 mole % being preferred as described in the detailed description), an improved image tone for a constant covering power is obtained, the more when a higher amount of PMT is present in the protective antistress layer, but the effect on image tone is lost back again when too high an amount of PMT is present. Most preferred is thus an amount of PMT per sq.m. and per mole of silver halide coated in the range of less than 1.5 mg.

Example 3

Preparation of tabular emulsion D.

To a solution of 6.9 g of an oxidized gelatin in 3 l of demineralized water at 51° C., adjusted to a pH of 2.5 by adding H2SO4, stirred up to a rate of 600 r.p.m., were added by a double jet method aqueous solutions of 0.98 M AgNO3 (hereinafter referred to as A1) and 0.98 M KBr (hereinafter referred to as B1): 25 ml of A1 and 25 ml of B1 were added in a time interval of 30 seconds. When the addition was completed, the temperature was increased up to 70° C. over a period of 30 minutes: UAg was controlled (expressed in mV versus a Ag/AgCl(sat.) reference electrode and should be in the range from 44.5+5 mV at a temperature of 70° C. +1° C. 1 minute later pH was set to a value of 5.0+0.3 and immediately thereafter a solution of 50 g of inert gelatin in 500 ml of demineralized water of 70° C. was added. 3 minutes later B1 was added at a rate of 7.06 ml/min. during 120 seconds, while simultaneously adding by double jet A1 at a rate of 7.5 ml/min.). In a further double jet addition A1 and B1 were added during 2822 seconds at a linearly increasing rate going from 7.0 up to 21.11 ml/min. for A1 and from 7.06 up to 21.29 ml/min. in order to maintain a constant UAg potential of +40 mV in the reaction vessel. After 5 minutes A1 and B1 were simultaneously added by double-jet addition during 60 seconds at a rate of 10.0 and 10.04 ml/min. respectively whereby the UAg value was held at a constant value of 50 mV while increasing the flow rate up to 46.49 ml/min. and 46.69 ml/min. respectively over a total time period of 81 min. and 5 seconds. After that double-jet addition period, an amount of an emulsion having ultrafine (ca. 0.040 μm) 100 % AgI crystals, dissolved in 20 g of demineralized water at 40° C., was added to the reaction vessel in order to get a total AgI content at the end of precipitation of 0.1 mole % vs. silver precipitated.

The average grain size of the silver bromoioide tabular {111} emulsion grains thus prepared, expressed as equivalent volume diameter, was 0.53 μm, the average thickness was 0.12 μm.

After washing, gelatin and water were added in order to obtain a silver halide content of 230.5 g/kg, expressed as AgNO3, and a gelatin content of 72.6 g/kg. To the emulsion having a weight of 3442 g, the pH of which was adjusted to 5.5, and to 344.2 g thereof was added consecutively 4 ml of a 1 wt. % KSCN solution, 50 mg (0.4 wt % solution, dissolved in 18 ml of methanol), of the azacyanine dye corresponding with the formula given hereinafter,

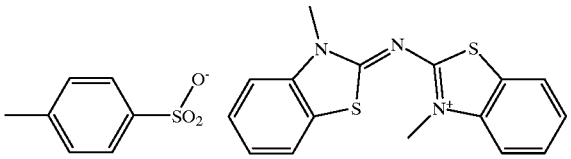

followed by addition, after 5 minutes of 2 ml of a 4.76×10−5 M solution of sodium toluenethiosulphonate in methanol, further followed by addition after 5 minutes of 1200 ml of a 0.25 wt. % solution of anhydro-5,5'-dichloro-3,3'-bis(n-propyl-3-sulphonate)-9-ethyl-benzoxa-carbocyanine triethylammonium salt, 5 mg of sodium thiosulphate dissolved in 10 ml of demineralized water at 35° C., 7 ml of a 0.001 wt. % solution of 2-carboxyethyl-N-benzothiazine selenide, 12 ml of a solution containing 1.456×10−3 M chloro auric acid and 1.58×10−2 M ammonium rhodanide, and finally 10 ml of a 1 wt. % solution of 1-(p-carboxyphenyl)-5-mercapto-tetrazole.

The emulsion D was chemically ripened at 50° C. during a time in order to get the best compromise between fog and sensitivity. After cooling phenol was added as a preservative. Coatings were made in the same way as in Example 1, for the Material D1 (comparative) and for the Material D2 (inventive), the only difference being addition to the protective antistress layer of 1-phenyl-5-mercaptotetrazole (PMT) for the inventive material.

Exposure and processing proceeded in the same way as in the Example 1 (G138i/G334i) after having preserved both materials for 12 days at a temperature of 45° C. and a relative humidity of 70%.

TABLE 3

| Matl. No. | x mg PMT/m$^2$ | $AgNO_3$ (g/m$^2$) | mole % AgI | F | S | CP | IT |
|---|---|---|---|---|---|---|---|
| D1(Comp.) | 0 | 5.16 | 0.1 | 198 | 169 | 77 | 193 |
| D2(Inv.) | 12 | 5.28 | 0.1 | 203 | 170 | 79 | 195 |

For a similar sensitometry, an improved image tone as well as an enhanced covering power was obtained as becomes clear from the data given in Table 3.

Example 4

Preparation of tabular emulsion E (comparative).

To a solution of 7.5 g of an oxidized gelatin in 1200 ml of demineralized water at 40° C., adjusted to a pH of 2.5 by adding H2SO4, stirred up to a rate of 500 rpm., further containing 20 mmole of KI, were added by a double jet method aqueous solutions of 2.94 M AgNO3 (hereinafter referred to as A1 ) and 2.94 M KBr (hereinafter referred to as B1): 6 ml of A1 and 1.9 ml of B1 were added in a time interval of 30 seconds. During this period, the reaction mixture was maintained at 40° C. When the addition was completed, stirring continued during 60 seconds and the temperature was increased up to 70° C. over a period of 40 minutes. Immediately thereafter a solution of 25 g of inert gelatin in 100 ml of demineralized water of 70° C. was added. 6 minutes later ultrafiltration was started on-line in order to reduce the volume in the reaction vessel and in the ultrafiltration unit up to 1500 ml per 500 g of AgNO3 present therein. By double-jet addition B1 was added simultaneously with A1 (at a rate of 2.7 ml/min.) and B1 (at a rate of 2.71 ml/min.) during 2 minutes. In a further double jet addition A1 and B1 were added during 53 minutes and 45 seconds at a linearly increasing rate going from the initial rates mentioned herinbefore up to 9.90 ml/min. for A1 and up to 9.93 ml/min. for B1. B1 was replaced by B2 (aqueous solution, wherein 10.18 ml of an aqueous solution of KI (2.94 M) were added to a solution of 650 ml of KBr (2.94 M)). After 5 minutes A1 and B2 were further added by double-jet during 50 minutes and 23 seconds at rates increasing up to 15.40 ml/min. and 15.45 ml/min. respectively.

Ultrafiltration on-line was ended and the temperature was decreased up to 45° C., while stirring was dcreased to 200 rpm.

Washing during ultrafiltration (pressure 1.8 bar) was performed in order to obtain an end mV value (vs. sat. Ag/AgCl reference electrode) of +80 mV, concentrating the washed emulsion up to a volume of 690 ml per 500 g of AgNO3.

Peptisation was performed at 45° C. in order to obtain an emulsion having 250 g AgNO3 and 16.3 g of gelatin per kg.

The average grain size of the silver bromoioide tabular {111} emulsion grains (composed of 99.0 mole % of AgBr and 1 mole % AgI based on silver) thus prepared, expressed as equivalent volume diameter, was 0.60 μm, the average thickness was 0.23 μm.

To 3370 g of this emulsion, of which pH was adjusted to 5.5, were added consecutively 4 ml of a 10 wt. % KSCN solution, 0.2 ml of a 4.76×10−3 M solution of sodium toluenethio-sulphonate in methanol, 780 ml of a 0.25 wt. % solution of anhydro-5,5'-dichloro-3,3'-bis(n-propyl-3-sulphonate)-9-ethyl-benzoxa-carbocyanine triethylammonium salt, 5.5 mg sodium thiosulphate dissolved in 10 ml of demineralized water, followed 1 minute later by addition of 3 ml of a 0.001 wt. % solution of 2-carboxyethyl-N-benzothiazine selenide, 3 minutes later: 7.0 ml of a solution containing 1.456×10−3 M chloro auric acid and 1.58×10−2 M ammonium rhodanide, and finally 10 ml of a 1 wt. % solution of 1-(p-carboxyphenyl)-5-mercapto-tetrazole and this mixture was chemically ripened during about 4 hours at 50° C. in order to get the best fog-speed relationship afterwards after coating in a photographic material. After cooling, phenol was added as a preservative.

Preparation of tabular emulsion I1 (inventive emulsion).

Same emulsion as emulsion E, except for the fact that B1 was left as halide salt solution in the double-jet additions in that B1 was not replaced by B2 (containing KI). Instead thereof an amount of an emulsion, dissolved in 20 g of demineralized water at 40° C., having ultrafine (ca. 0.040 μm) 100% AgI crystals was added to the reaction vessel in order to get a total AgI content at the end of precipitation of 0.1 mole % vs. silver precipitated.

After a physical ripening time of 20 min. stirring was ended in the reaction vessel, followed by ending ultrafiltration-on-line and further washing by ultrafiltration, peptisation and chemical sensitisation as for emulsion E.

Preparation of tabular emulsion I2 (inventive emulsion).

Same emulsion as emulsion I1, except for addition after silver bromide precipitation of an amount of an emulsion having ultrafine (ca. 0.040 μm) 100% AgI crystals, dissolved in 20 g of demineralized water at 40° C., added to the reaction vessel in order to get a total AgI content at the end of precipitation of 0.2 mole % (instead of 0.1 mole %) vs. silver precipitated.

Preparation of tabular emulsion I3 (inventive emulsion).

Same emulsion as emulsion I1, except for addition after silver bromide precipitation of an amount of an emulsion having ultrafine (ca. 0.040 μm) 100% AgI crystals, dissolved in 20 g of demineralized water at 40° C., added to the reaction vessel in order to get a total AgI content at the end of precipitation of 0.3 mole % (instead of 0.1 mole %) vs. silver precipitated.

Coating of the materials

Preparation of the film materials I1–I3 and E

Film materials were called I1–I3 for those coated with the inventive emulsions and E for the one coated with the comparative emulsion in the light-sensitive emulsion layer of the respective film materials. As stabilizers in the emulsion layer coatings of the emulsions I1–I3 and C 0.1 mmole of 1-(m-carboxymethylthio-acetamido)-phenyl-5-mercaptotetrazole and 0.6 mmole of 5-methyl-1,2,4-triazolo-(1,5-a)-pyrimidine-7-ol were added per mole of silver.

Resorcinol was added as hardener stabilizer in an amount of 2.8 g per mole of Ag. Consecutively 0.5 g of polyglycol (MW=6000) was added as a development accelerator; 20 ml of polyoxyethylene surfactant H17C8-Phenyl-(O—CH2—CH2)8—O—CH2—COOH and in an amount of 140 mg (per mole of Ag) fluoroglucinol was added as a hardener accelerator together with polymethyl acrylate latex (in an amount of 140% by weight, based on the amount of gelatin binder) which was used as a plasticizer. The thus prepared emulsion coating solutions were coated on a blue colored polyethylene terephthalate support (density of the support measured to be 0.200) in such an amount in order to give a coating weight of 2.75 g/m2 per side in terms of AgNO3 and 1.42 g of gelatin per m2 per side.

The protective layer coated thereupon (pH value: 6.25) at both sides was the same as the one described in Example 1, but an amount of 12 mg/m2 of PMT (1-phenyl-5-mercaptotetrazole) was additionally added.

Materials have been numbered I1 to I3 and E, corresponding with the numbers of the Emulsions I1–I3 and E. Samples of these coatings were exposed with green light of 540 nm during 0.1 seconds using a continuous wedge and were processed.

The processing was run in the developer G138i and in the fixer G334, both trademarked products from Agfa-Gevaert N. V., Mortsel, Belgium, followed by rinsing at the indicated temperature of 33° C. for a total processing time of 90 seconds.

Further parameters given in the Table 4 hereinafter are the same as for Example 1, except for the contrast or gradation GG:

Gradation (contrast) "GG", given as an integer after having multiplied with a factor of 100 the real gradation—contrast—figure as measured between a density of 1.0 and 2.0 above minimum density;

TABLE 4

| Matl. No. | Mole % AgI | $AgNO_3$ ($g/m^2$) | F | S | GG | CP | IT |
|---|---|---|---|---|---|---|---|
| E | 1.0 | 6.51 | 187 | 174 | 317 | 60 | 195 |
| I1 | 0.1 | 6.41 | 185 | 175 | 297 | 57 | 198 |
| I2 | 0.2 | 6.59 | 188 | 171 | 315 | 60 | 199 |
| I3 | 0.3 | 6.58 | 195 | 167 | 326 | 59 | 200 |

As becomes clear from the data given in Table 1 a continuously (about linearly) increasing amount of silver iodide (from 0.1 up to 0.4 mole % based on silver) provides a visible improved image tone for an about constant covering power, if compared with a material coated with an emulsion having 1 mole % of silver iodide. It is clear that presence of the mercaptotetrazole compound (3) in the protective antistress layer further fortifies this positive effect on image tone.

Example 5

Preparation of tabular emulsion I4.

To a solution of 6.9 g of an oxidized gelatin in 3 l of demineralized water at 51° C., adjusted to a pH of 2.5 by adding H2SO4, stirred up to a rate of 600 r.p.m., were added by a double jet method aqueous solutions of 0.98 M AgNO3 (hereinafter referred to as A1) and 0.98 M KBr (hereinafter referred to as B1): 25 ml of A1 and 25 ml of B1 were added in a time interval of 30 seconds. During this period, the reaction mixture was maintained at 51° C. 2 minutes later the temperature was increased up to 70° C. over a period of 30 minutes. 1 minute later pH was set to a value of 5.0+0.3 and immediately thereafter a solution of 50 g of inert gelatin in 500 ml of demineralized water of 70° C. was added. 3 minutes later B1 was added at a rate of 7.06 ml/min. during 120 seconds, while simultaneously adding by double jet A1 at a rate of 7.5 ml/min.

In a further double jet addition A1 and B1 were added during 2822 seconds at a linearly increasing rate going from 7.0 up to 21.11 ml/min. for A1 and from 7.06 up to 21.29 ml/min. for B1.

After 5 minutes A1 and B1 were simultaneously added by double-jet addition during 60 seconds at a rate of 10.0 and 10.04 ml/min. respectively whereby the UAg value was held at a constant value of 50 mV while increasing the running velocity up to a rate of 46.49 ml/min. and 46.69 ml/min. respectively over a total time period of 81 min. and 5 seconds.

After that double-jet addition period, an amount of an emulsion having ultrafine (ca. 0.040 μm) 100% AgI crystals, dissolved in 20 g of demineralized water at 40° C., was added to the reaction vessel in order to get a total AgI content at the end of precipitation of 0.1 mole % vs. silver precipitated.

The average grain size of the silver bromoioide tabular {111} emulsion grains thus prepared, expressed as equivalent volume diameter, was 0.53 μm, the average thickness was 0.12 μm.

After washing, gelatin and water were added in order to obtain a silver halide content of 230.5 g/kg, expressed as AgNO3, and a gelatin content of 72.6 g/kg. To 3442 g of this emulsion, of which pH was adjusted to 5.5, were added consecutively 4 ml of a 10 wt. % KSCN solution, 72 mg of the azacyanine dye corresponding with the formula (III.3) but with the tosylate anion of compound (III.5); 0.4 wt %), dissolved in 18 ml of methanol were added, followed by addition, after 5 minutes of 0.2 ml of a 4.76×10−3 M solution of sodium toluenethiosulphonate in methanol, further followed by addition after 5 minutes of 1200 ml of a 0.25 wt. % solution of anhydro-5,5'-dichloro-3,3'-bis(n-propyl-3-sulphonate)-9-ethyl-benzoxa-carbocyanine triethylammonium salt, 7.5 mg of sodium thiosulphate dissolved in 10 ml of demineralized water at 35° C., 8.5 ml of a 0.001 wt. % solution of 2-carboxyethyl-N-benzothiazine selenide, 18.5 ml of a solution containing 1.456×10−3 M chloro auric acid and 1.58×10−2 M ammonium rhodanide, and finally 10 ml of a 1 wt. % solution of 1-(p-carboxyphenyl)-5-mercapto-tetrazole. This mixture was chemically ripened during about 3 hours at 50° C. in order to get the best compromise between fog and sensitivity. After cooling phenol was added as a preservative.

Preparation of tabular emulsion I5.

Same preparation steps as for emulsion I4, except for addition after the last double-jet addition period to the reaction vessel of an amount of an emulsion having ultrafine (ca. 0.040 μm) 100% AgI crystals, dissolved in 20 g of demineralized water at 40° C. in order to get a total AgI content at the end of precipitation of 0.2 mole % vs. silver precipitated.

Preparation of tabular emulsion I6.

Same preparation steps as for emulsion I4, except for addition after the last double-jet addition period to the reaction vessel of an amount of an emulsion having ultrafine (ca. 0.040 μm) 100% AgI crystals, dissolved in 20 g of demineralized water at 40° C. in order to get a total AgI content at the end of precipitation of 0.3 mole % vs. silver precipitated.

Preparation of tabular emulsion I7.

Same preparation steps as for emulsion I4, except for addition after the last double-jet addition period to the rtaction vessel of a solution of 1 wt% of potassium iodide 40° C. in order to get a total AgI content at the end of precipitation of 0.1 mole % vs. silver precipitated.

Preparation of tabular emulsion I8.

Same preparation steps as for emulsion I7, except for addition after the last double-jet addition period to the reaction vessel of a solution of 1 wt% of potassium iodide 40° C. in order to get a total AgI content at the end of precipitation of 0.2 mole % vs. silver precipitated.

Preparation of tabular emulsion I9.

Same preparation steps as for emulsion I7, except for addition after the last double-jet addition period to the reaction vessel of a solution of 1 wt% of potassium iodide 40° C. in order to get a total AgI content at the end of precipitation of 0.3 mole % vs. silver precipitated.

Emulsions I4–I9 were coated in the same way as in Example 4 (with the same protective antistress layer as in Example 4, containing an amount of 12 mg/m2 of PMT (1-phenyl-5-mercaptotetrazole)) and further the corresponding materials, all having about 5.0 g of silver nitrate per sq.m. were exposed and processed in the same way. Parameters in Table 5 have the same significance as in Table 4.

TABLE 5

| Matl. No. | Mole % AgI | F | S | GG | IT |
|---|---|---|---|---|---|
| I4 | 0.1 | 190 | 169 | 348 | 195 |
| I5 | 0.2 | 195 | 174 | 332 | 196 |
| I6 | 0.3 | 194 | 172 | 337 | 197 |
| I7 | 0.1 | 187 | 175 | 322 | 195 |
| I8 | 0.2 | 190 | 174 | 320 | 197 |
| I9 | 0.3 | 193 | 172 | 321 | 198 |

As becomes confirmed from the data given in Table 5 a continuously (about linearly) increasing amount of silver iodide (from 0.1 up to 0.3 mole % based on silver) provides an improved image tone, independent from the source of iodide ions (same conclusion when adding ultrafine AgI grains or potassium iodide salt as a source for iodide ions).

Example 6

Emulsion I10 was prepared in the same way as the one in Example 4 having 0.1 mole % iodide based on silver, called Emulsion I1.

Emulsions I11–I13 were prepared after dividing the emulsion I10 into 4 parts and addition, before chemical ripening, amounts of AgI ultrafine grains of 0.040 μm, in an amount in order to get 0.2 mole % of AgI (for the second part=emulsion I11); 0.3 mole % of AgI (for the third part=emulsion I12); and 0.4 mole % of AgI (for the fourth part=emulsion I13).

Emulsions I10–I13 were coated in the same way as in Example 4, having in its protective antistress coating an amount of 12 mg/m2 of PMT (1-phenyl-5-mercaptotetrazole, and further the corresponding materials were exposed and processed in the same way. Parameters in Table 6 have the same significance as in Table 4 and were determined after exposure and processing as in Example 1, except for the fact that Material No. I10 has been taken as a reference an that differences with respect thereto have been given (differences as absolute differences for Fog, Speed, Covering Power and Image Tone; % for gradation GG). In addition the Absorption "ABS." (density given as figure× 100) and the maximum absorption maximum max (in nm) of the absorption spectra have been given.

Moreover cross-over percentages have been dealt with. The cross-over percentage (C.O.%) was determined as follows. Double side coated samples were adjusted between a single green light emitting screen (CURIX Ortho Regular, trademarked product from Agfa-Gevaet N V, Mortsel, Belgium) and a white paper replacing the second screen. This film-screen element directed with its light emitting screen to the X-ray tube, was exposed with varying radiation doses, expressed as log E(xposure). After processing the minimum dose needed to obtain a density of 0.5 above fog was determined from the front layer (log Efront) and from the back layer (log Eback) separately. The cross-over percentage was then calculated from the following equation:

$$\% \text{ C.O.}=100\text{: antilog (log Eback}-\text{log Efront)}$$

TABLE 6

| Matl. No. | Mole % AgI | ABS. | ΔF | ΔS | ΔGG (%) | ΔCP | ΔIT | $\Lambda_{max}$ | C.O. % |
|---|---|---|---|---|---|---|---|---|---|
| I10 | 0.1 | 151 | 0 | 0 | 0 | 0 | 0 | 546 | 34 |
| I11 | 0.2 | 150 | +2 | −1 | +2 | +1 | +1 | 545 | 33 |
| I12 | 0.3 | 148 | +4 | −2 | +1 | +2 | +2 | 544 | 35 |
| I13 | 0.4 | 142 | +0 | −5 | +1 | −1 | +3 | 544 | 36 |

Image tone is improved in a "density amount" of about 0.01 per 0.1 mole % of iodide when iodide is increased at the surface of the grains. Fog, speed and gradation are about the same within acceptable boundaries when increasing iodide concentrations. Otherwise there is a small hypsochromic wavelength shift when increasing iodide concentrations, a slight increase in cross-over percentage when increased amounts of iodide are present at the surface of the grains. The cross-over phenomenon having a slightly negative tendency are however still acceptable and are certainly not prohibitive.

In order to obtain the data for the parameters at different developer temperatures in order to examine the developability as a function of differing iodide concentrations at the surface of the tabular grains, samples of these coatings were exposed with green light of 540 nm during 0.1 seconds using a continuous wedge and were processed at differing temperatures in the weak hydroquinone developer, pH set at 10.0, the composition of which is given in Table 7 hereinafter (fixer being the same as hereinbefore, namely G334i). As indicated in the Table 8, said temperatures were 29° C., 32° C., 35° C. and 38° C. For total processing times of 45 s data in for differing developer temperatures have been given for Fog, Speed and Gradation in the Table 8.

TABLE 7

| Composition of weak hydroquinone developer | |
|---|---|
| Developer H2Q | |
| Hydroquinone | 13.3 g/l |
| Phenidone | 0.8 g/l |
| Sodium EDTA | 1.33 g/l |
| Potassium hydroxide | 27.9 g/l |
| Sodium tetraborate.10 aq | 8.8 g/l |
| Acetic acid | 5.2 g/l |
| 5-methyl benzotriazole | 0.04 g/l |
| 5-nitrobenzimidazole | 0.05 g/l |
| glutardialdehyde | 3.0 g/l |
| diethylene glycol | 12.8 g/l |

TABLE 8

| Matl No. | mole % AgI | F29 | F32 | F35 | F38 | S29 | S32 | S35 | S38 | GG29 | GG32 | GG35 | GG38 |
|---|---|---|---|---|---|---|---|---|---|---|---|---|---|
| I10 | 0.1 | 201 | 203 | 208 | 218 | 165 | 154 | 147 | 140 | 248 | 261 | 262 | 253 |
| I11 | 0.2 | 203 | 205 | 208 | 222 | 165 | 154 | 145 | 139 | 247 | 258 | 261 | 251 |
| I12 | 0.3 | 203 | 204 | 214 | 226 | 163 | 152 | 144 | 138 | 243 | 251 | 254 | 243 |
| I13 | 0.4 | 203 | 204 | 209 | 222 | 166 | 155 | 146 | 141 | 243 | 249 | 252 | 243 |

As becomes clear from the data in Table 8 developability remains almost the same when increasing iodide concentrations at the crystal surface of the {111} tabular silver bromoiodide grains having silver iodide at their grain surfaces up to a limited amount of 0.4 mole % based on silver.

Having described in detail preferred embodiments of the current invention, it will now be apparent to those skilled in the art that numerous modification can be therein without departing from the scope of the invention as defined in the appending claims.

What is claimed is:

1. Radiographic film material comprising a transparent film support having first and second major surfaces coated, apart from a subbing layer and, optionally, a non-light sensitive hydrophilic layer thereupon, with at least one light-sensitive silver halide emulsion layer overcoated with a protective antistress layer, said emulsion layer(s) having chemically and spectrally sensitized {111} tabular hexagonal core-shell emulsion grains or crystals in an amount of at least 50% of the total projective grain surface of all grains, said grains being composed of a silver bromide core and a silver bromoiodide shell having an average amount over the whole crystal volume of more than 90 mole % of silver bromide, said grains further having a mean equivalent volume diameter of from 0.3 $\mu$m up to 1.0 $\mu$m and an average grain thickness of less than 0.30 $\mu$m, wherein said film material is coated with a total amount of silver, expressed as an equivalent amount of silver nitrate of less than 7 g/m2, characterized in that all silver iodide is present in an outermost shell corresponding with at most 20% of all silver halide precipitated in order to provide silver iodide to be present in the whole grain volume of said tabular grains in an average amount of less than 1 mole % of iodide, based on silver and in that at least said protective antistress layer comprises a mercapto-tetrazole compound according to the general formula (I), (I)

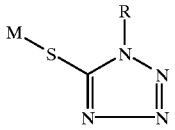

wherein R represents a substituted or unsubstituted alkyl, aryl or aralkyl and wherein M represents a hydrogen atom, an alkali metal atom or an ammonium group, in an amount of at least 0.5 mmole per mole of silver halide coated.

2. Radiographic film material comprising a transparent film support having first and second major surfaces coated, apart from a subbing layer and a non-light sensitive hydrophilic layer thereupon, with at least one light-sensitive silver halide emulsion layer overcoated with a protective antistress layer, said emulsion layer(s) having chemically and spectrally sensitized {111} tabular hexagonal core-shell emulsion grains or crystals in an amount of at least 50% of the total projective grain surface of all grains, said grains being composed of a silver bromide core and a silver bromoiodide shell having an average amount over the whole crystal volume of more than 90 mole % of silver bromide, said grains further having a mean equivalent volume diameter of from 0.3 $\mu$m up to 1.0 $\mu$m and an average grain thickness of less than 0.30 $\mu$m, wherein said film material is coated with a total amount of silver, expressed as an equivalent amount of silver nitrate of less than 7 g/m2, characterized in that all silver iodide is present in an outermost shell corresponding with at most 20% of all silver halide precipitated in order to provide silver iodide to be present in the whole grain volume of said tabular grains in an average amount of less than 1 mole % of iodide, based on silver and in that at least said non-light sensitive hydrophilic layer comprises a mercapto-tetrazole compound according to the general formula (I), (I)

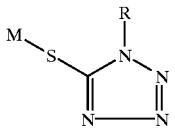

wherein R represents a substituted or unsubstituted alkyl, aryl or aralkyl and wherein M represents a hydrogen atom, an alkali metal atom or an ammonium group, in an amount of at least 0.5 mmole per mole of silver halide coated.

3. Material according to claim 1 or 2, wherein said compound according to the general formula (I) is 1-phenyl-5-mercaptotetrazol.

4. Material according to claim 1 or 2, wherein all silver iodide is present on the grain surface of the said core-shell tabular grains in an amount in order to get an average amount of iodide from 0.1 mole % up to 0.4 mole % based on silver over the whole grain volume.

5. Material according to claim 1 or 2, wherein the chemically and spectrally sensitized {111} tabular hexagonal grains have an average grain thickness of from 0.05 up to 0.25 $\mu$m.

6. Material according to claim 1 or 2, wherein said grains have been made sensitive to the ultraviolet and/or blue range of wavelength spectrum.

7. Material according to claim 1 or 2, wherein said grains have been made sensitive to the green region of the wavelength spectrum.

8. Material according to claim 1 or 2, wherein the total amount of silver halide coated in said film material, expressed as an equivalent amount of silver nitrate, is in the range from 3.0 to 6.6 g/m2.

9. Radiographic screen/film combination or system comprising a radiographic film material according to claim 1 or 2, sandwiched between a pair of supported or self-supporting X-ray intensifying screens, wherein said pair of supported or self-supporting X-ray intensifying screens comprises luminescent phosphor particles emitting at least 50% of their emitted radiation in the wavelength range for which said material has been made spectrally sensitive.

10. Radiographic screen/film combination according to claim 9, said combination comprising a duplitized film material, sandwiched between a pair of supported or self-supporting X-ray intensifying screens, characterized in that said pair of supported or self-supporting X-ray intensifying screens essentially consists of luminescent phosphor particles emitting at least 50% of their emitted radiation in the green wavelength range from 500 nm to 550 nm; said film comprising {111} tabular silver halide grains, spectrally sensitive to irradiation in the said wavelength range from 500 to 550 nm by the presence of at least one J-aggregating green spectral sensitizer and of at least one non-J-aggregating dye selected from the group consisting of azacyanine dyes and monomethine cyanine dyes.

11. Radiographic screen/film combination according to claim 9, comprising a duplitized film material, sandwiched between a pair of supported or self-supporting X-ray intensifying screens, characterized in that said pair of supported or self-supporting X-ray intensifying screens essentially consists of luminescent phosphor particles emitting at least 50% of their emitted radiation in the wavelength range shorter than 420 nm, said film comprising {111} tabular silver halide grains rich in silver bromide, spectrally sensitive to irradiation in the said wavelength range shorter than 420 nm by the presence of at least one J-aggregating blue spectral sensitizer and of at least one the non-J-aggregate forming dyes selected from the group consisting of azacyanine dyes and monomethine cyanine dyes, wherein said emulsion is present in at least one light-sensitive emulsion layer on at least one side of the film support.

12. Black-and-white image-forming method comprising the steps of contacting the film material according to claim 1 or 2 sandwiched between a pair of supported or self-supporting X-ray intensifying screen(s), wherein said intensifying screens comprise luminescent phosphor particles emitting at least 50% of their emitted radiation in the wavelength range for which said material has been made spectrally sensitive;

exposing the film material to X-rays passing a subject to be examined, while being in contact with the said screens;

processing the film material by the steps of developing, fixing, rinsing and drying.

13. Material according to claim 1 or 2, wherein said compound according to the general formula (I) is present in an amount of from 1 mmole up to 10 mmole per mole of silver halide coated.

* * * * *